US005810174A

United States Patent [19]

Hamada et al.

[11] Patent Number: 5,810,174

[45] Date of Patent: Sep. 22, 1998

[54] SORTER SYSTEM HAVING A PLURALITY OF SORTERS CONNECTED TO ONE ANOTHER

[75] Inventors: Yasunori Hamada; Taichiro Yamashita, both of Tsuchiura; Kazushi Yoshida, Ibaraki-ken; Takao Terayama, Ushiku; Tadashi Osaka; Junichi Tamamoto, both of Ibaraki-ken; Toshihiko Tajiri, Owariasahi, all of Japan

[73] Assignee: Hitachi, Ltd., Tokyo, Japan

[21] Appl. No.: 516,985

[22] Filed: Aug. 18, 1995

[30] Foreign Application Priority Data

Aug. 19, 1994 [JP] Japan ..... 6-195141

[51] Int. Cl.[6] ..... B07C 5/00

[52] U.S. Cl. ..... 209/584; 209/656; 209/900; 271/4.01; 271/4.02

[58] Field of Search ..... 209/552, 559, 209/562, 563, 564, 583, 584, 656, 900; 217/3.14, 4.01, 4.02

[56] References Cited

U.S. PATENT DOCUMENTS

| | | | |
|---|---|---|---|
| 4,388,994 | 6/1983 | Suda et al. | 209/900 X |
| 4,482,059 | 11/1984 | Horii et al. | 209/584 X |
| 4,601,396 | 7/1986 | Pavie | 209/584 X |
| 5,433,325 | 7/1995 | Levaro et al. | 209/900 X |

FOREIGN PATENT DOCUMENTS

| | | | |
|---|---|---|---|
| 0 065 715 A1 | 12/1982 | European Pat. Off. . | |
| 0 556 456 A1 | 10/1993 | European Pat. Off. . | |
| 566456 | 10/1993 | European Pat. Off. | 209/584 |
| 0 575 032 A2 | 12/1993 | European Pat. Off. . | |
| 8403680 | 7/1986 | Netherlands | 209/584 |
| WO 90/12660 | 11/1990 | WIPO . | |

*Primary Examiner*—William E. Terrell
*Assistant Examiner*—Tuan N. Nguyen
*Attorney, Agent, or Firm*—Antonelli, Terry, Stout & Kraus, LLP

[57] ABSTRACT

The present invention provides a sorter system wherein sorters that can perform sorting operations such as destination and delivery sorting operations and sequencing operations such as a carrier route sequencing operation for sheets with sorting information attached thereto as required can be configured. Transfer devices are coupled to sorting information readers means for reading sorting information from sheets transferred by transfer devices. A plurality of sorters for loading the sheets therein according to the sorting information read by the sorting information readers are coupled to the transfer devices in such a way that any number of sorters can be added or removed from said sorters as required. This invention can provide a sorter system capable of expanding sorting and sequencing functions, and also reduce costs and a required installation space.

23 Claims, 8 Drawing Sheets

SORTER SYSTEM HAVING A PLURALITY OF SORTERS CONNECTED TO ONE ANOTHER

BACKGROUND OF THE INVENTION

1. Field of the Invention

The present invention relates to a sorter system capable of sorting sheets to which sorting information is attached, and in particular to a sorter system capable of sorting sheets into major or minor groups according to various sorting or sequencing operations.

2. Description of the Related Art

Various sorting operations using sorting information attached to sheets are carried out according to the purpose of sorting. As an example of conventional sheet sorting operation, various sorting operations executed at a post office for mails with a destination and a zip code attached thereto are explained below.

In the first mail sorting operation executed at a post office, addresses and zip codes indicated on mails which have been put in the post are used to sort the mails for respective post offices corresponding to the sorting information (referred to as "destination sorting operation"). In the second sorting operation, the mails, which have reached the corresponding post office, are sorted for corresponding deliverers and delivery zones (referred to as a "delivery sorting operation"), and the mails sorted for the corresponding deliverers and delivery zones are then sequenced according to actual carrier routes (referred to as a "carrier route sequencing operation"). These operations were manually performed, but various apparatuses have recently been used for them to efficiently handle ever-increasing mails.

The conventional apparatuses for these mail sorting operations have been proposed in (1) Japanese Patent Unexamined Publication No. 57-156076, (2) Japanese Patent Unexamined Publication No. 63-287584, and (3) Japanese Patent Unexamined Publication No. 6-452.

The conventional technique described in (1) performs sorting operations at a post office using an apparatus comprising primary and secondary mail reading sorters for sorting mails into a primary group destined for the suburbs for which a large number of mails are destined and a secondary group destined for local areas for which a small number of mails are destined, a primary and secondary switching reading sorter for selectively switching between the primary and secondary destination sorters, and a transfer path through which mails are transferred among the primary group reading sorter, secondary group reading sorter, and primary and secondary switching reading sorter.

The conventional technique described in (2) reduces the number of sorting operations by performing a destination sorting operation without the use of a large number of sorters, storing sorting information read during the destination sorting operation, and after sorting the sorting information according to delivery zones and further sequencing it according to carrier routes, storing the data, which is subsequently used to sequence the carrier routes.

The conventional technique described in (3) reads sorting information attached to sheets, distributes them to groups of sorting boxes each corresponding to the sorting information, sequentially sorts and stack the distributed sheets in the individual sorting boxes, and takes them out from the sorting boxes in the order according to data indicating the order within each group to set their order within each group.

The conventional technique described in (1) does not take a delivery sorting or carrier route sequencing operation into consideration, or provide sufficient consideration for various sorting operations carried out at a post office.

The conventional technique described in (2) does not take into consideration the transmission of sorting information read and stored during a destination sorting operation to the post office at a delivery point or the association of sorting information with a mail both sent to the post office at the delivery point as well as their handling.

The conventional technique described in (3) does not take the destination sorting operation into consideration. That is, various automatic machines have conventionally been proposed for each operation.

The number of mails has been increasing year by year, and labor is not sufficient to properly meet this need.

Each mail sorting operation requires automatic machines such as sorters according to the operation. For example, for the number of sorting shelves required for each sorting operation, the destination sorting operation requires that this number be equal to the number of post offices corresponding to the destinations of mails. The use of a small sorter with a small number of sorting shelves may require re-sorting due to the inability to achieve sufficient sorting in a single destination sorting operation cycle, and also require an apparatus for carrying sorted mails for re-sorting or transferring mails. Conversely, the use of a large sorter with a large number of sorting shelves result in some of the sorting shelves remaining unused, leading to wasteful installation space.

The delivery sorting operation requires that the number of sorting shelves be equal to that of deliverers or delivery zones. The use of inadequate or insufficient sorting shelves may result in the same disadvantages as in the destination sorting operation.

The carrier route sequencing operation requires sorting shelves the number of which is as required for sequencing. If a small sorter with a small number of sorting shelves are used for carrier route sequencing operation, sorting operations must be repeated several times due to the inability to perform sequencing in a single operation cycle, resulting in the need of an apparatus for carrying sorted mails for re-sorting or transferring mails. Conversely, if a large sorter with a large number of sorting shelves are used to perform the carrier route sequencing operation in a single operation cycle and if a single deliverer delivers mails to about 1,000 homes, then about 1,000 sorting shelves are required to meet this need, resulting in a very large sorter.

In addition, each post office must perform each operation within a predetermined period of time and then pass mails to the subsequent process or post offices at destinations. Post offices dealing with a large number of mails must install therein a plurality of various automatic machines according to the mails. In urban post offices dealing with a large number of mails, however, it is difficult to obtain a space in which a plurality of various automatic machines are installed, and small automatic machines are required to address various operations. Post offices dealing with a small number of mails, however, cannot install various automatic machines therein due to the investment efficiency, and requires small versatile automatic machines.

SUMMARY OF THE INVENTION

An object of this invention is to provide a sorter system that can be installed in any post offices whether they are dealing with a large or small number of mails and that can read sorting information attached to sheets to perform various sorting and sequencing operations such as the above mail destination sorting, delivery sorting, and carrier route sequencing operations based on the sorting information.

Another object of this invention is to provide a sorter system that can in particular process a large number of sheets and that enables the above various sorting and sequencing operations.

To achieve the above objects, this invention comprises a singulating means for separating sheets to which sorting information is attached, a transfer means for transferring the sheets separated by the singulating means, a sorting information reading means for reading the sorting information for the sheets transferred by the transfer means coupled to the sorting information reading means, and a plurality of sorters for loading the sheets therein according to the sorting information read by the sorting information reading means.

With the above configuration, an apparatus according to this invention can perform the destination sorting, delivery sorting, or carrier route sequencing operation.

That is, in the destination sorting operation, the sorting shelves of a plurality of sorters are defined for each required destination, and the sorter system according to this invention is then started. Sheets with sorting information attached thereto are separated by the singulating means, and then transferred to the sorting information reading means, where the sorting information is read from the sheets. The sheets from which the sorting information has been read are transferred by the transfer means to the respective sorters defined for the corresponding destinations, and stacked in each sorting shelf. In this manner, the destination sorting operation is performed.

In the delivery sorting operation, a plurality of sorters is defined for each deliverer and each delivery zone to start a sorter system of the present invention. Same as the destination sorting operation, sheets with sorting information are separated by the singulating means, and then transferred to the sorting information reading means, where the sorting information is read from the sheets. The sheets from which the sorting information has been read are transferred by the transfer means to the respective sorters defined for the corresponding destinations, and stacked in each storing shelf. In this manner, the delivery sorting operation is performed.

In the carrier route sequencing operation, the above delivery sorting operation is first carried out. After the delivery sorting operation, the sheets that have been sorted for each deliverer and each delivery zone have been stacked in each sorter. The sheets stacked in each sorter are then subjected to carrier route sequencing to achieve the carrier route sequencing operation.

DESCRIPTION OF THE PREFERRED EMBODIMENTS

Figure 1:
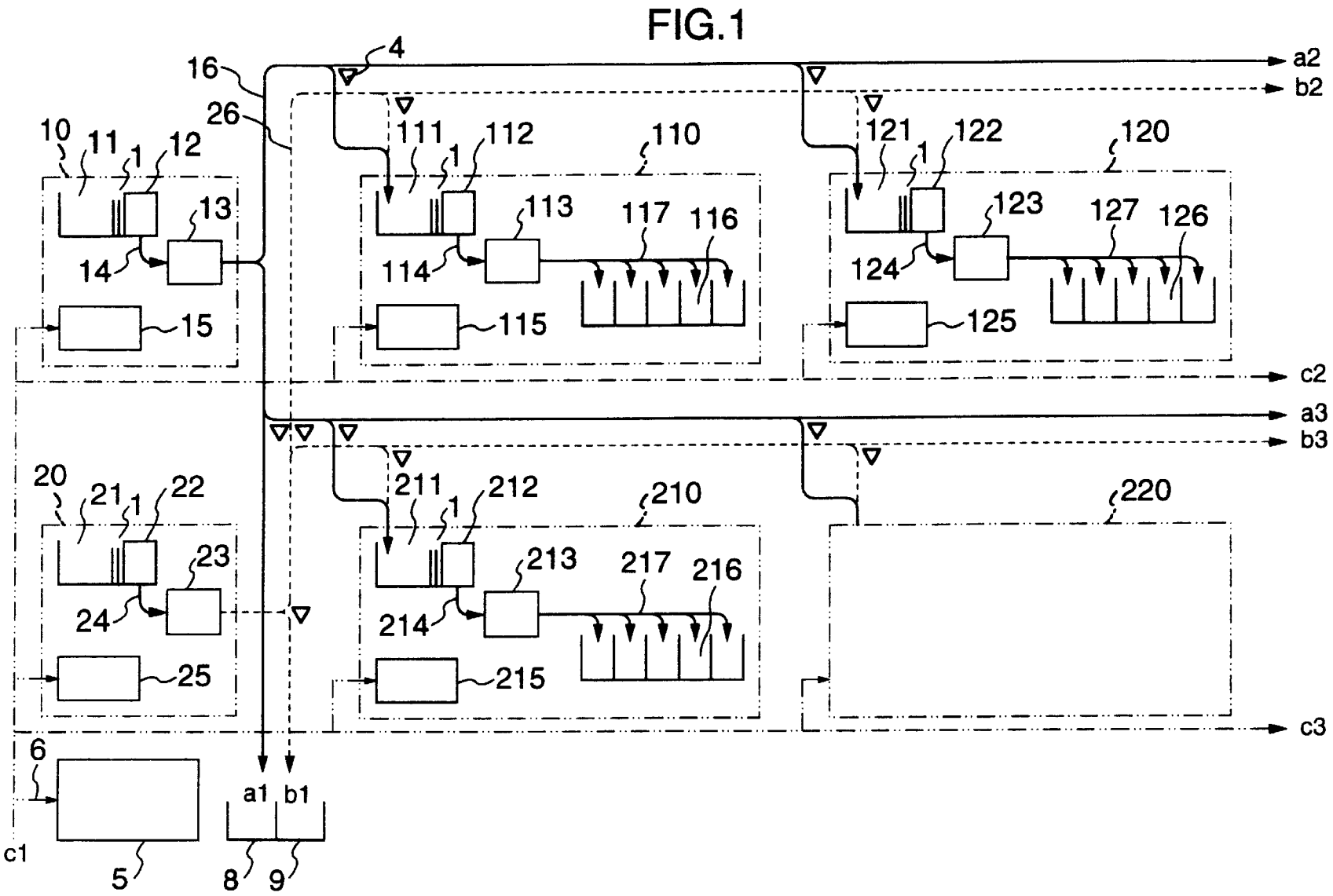
FIG. 1 is a general block diagram showing one embodiment of a sorter system according to this invention.
Figure 2:
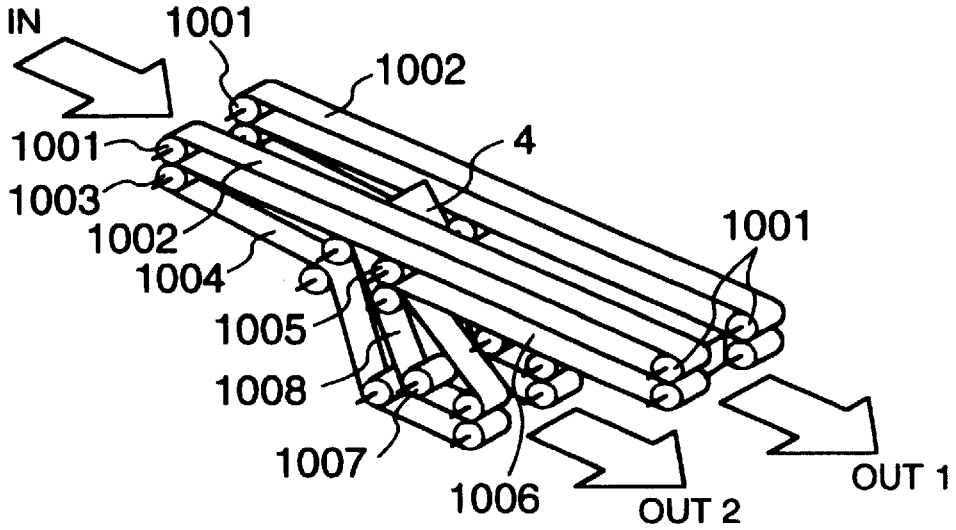
FIG. 2 is a perspective view showing one embodiment of a transfer and a gate means used for one embodiment of the sorter system according to this invention.
Figure 3:
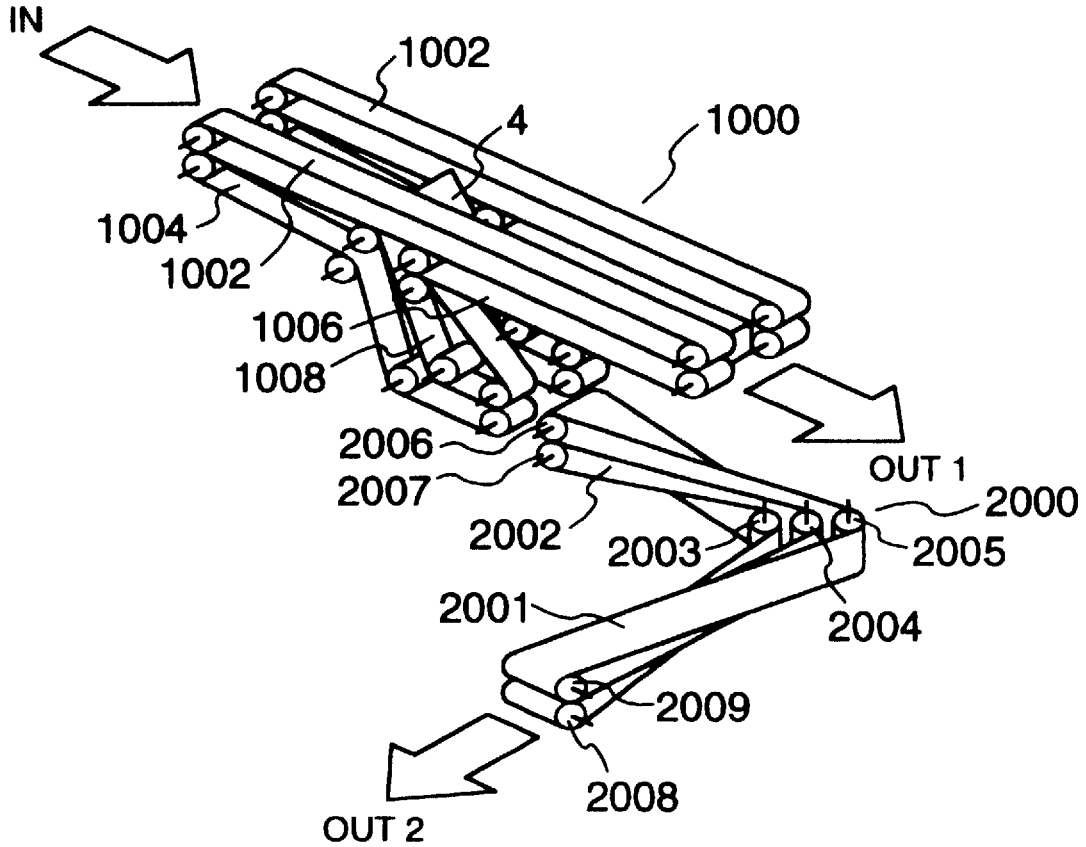
FIG. 3 is a perspective view showing one embodiment of a transfer means for changing the transfer direction which is used for one embodiment of the sorter system according to this invention.
Figure 4:
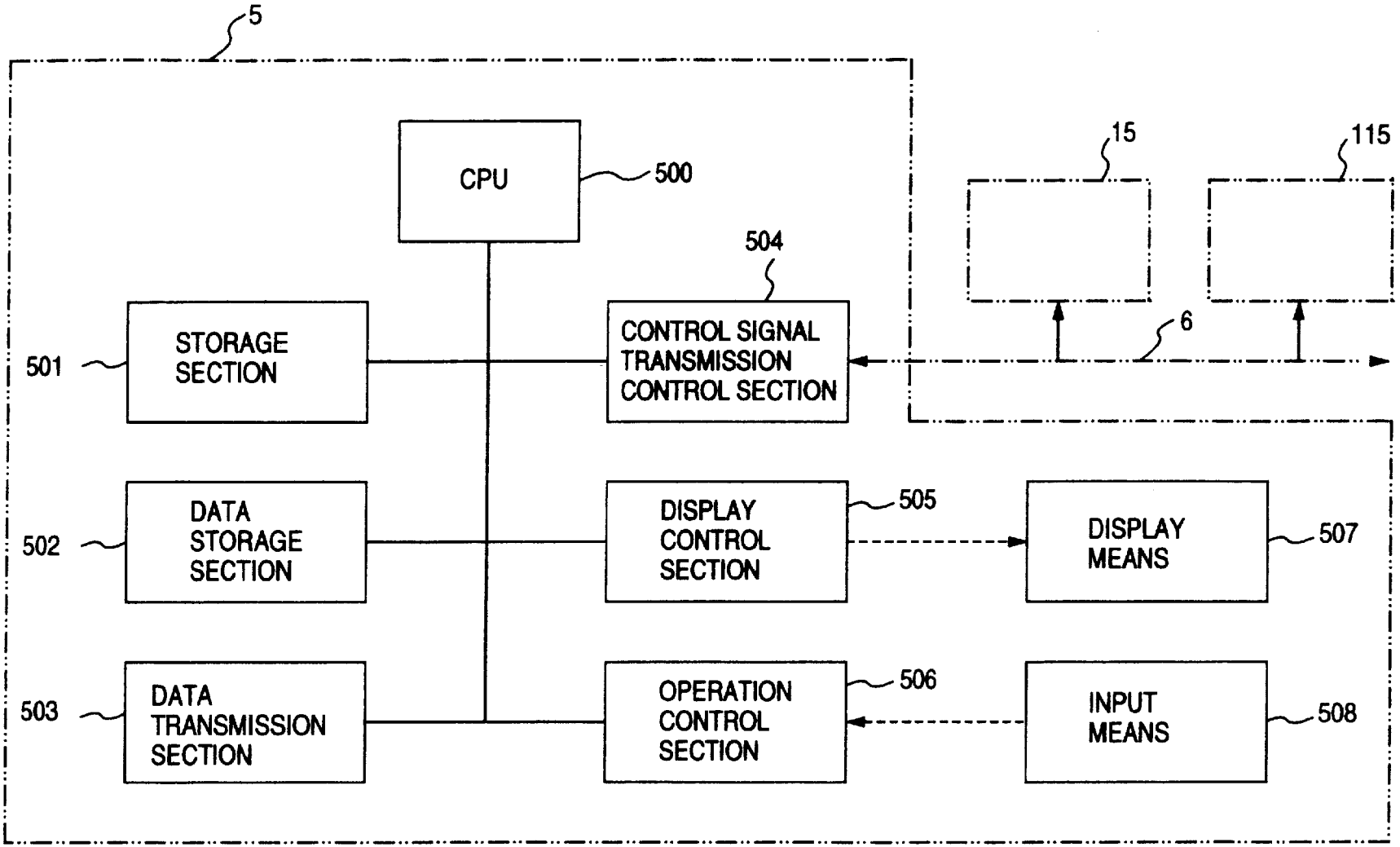
FIG. 4 is a block diagram showing one embodiment of a control means used for one embodiment of the sorter system according to this invention.
Figure 5:
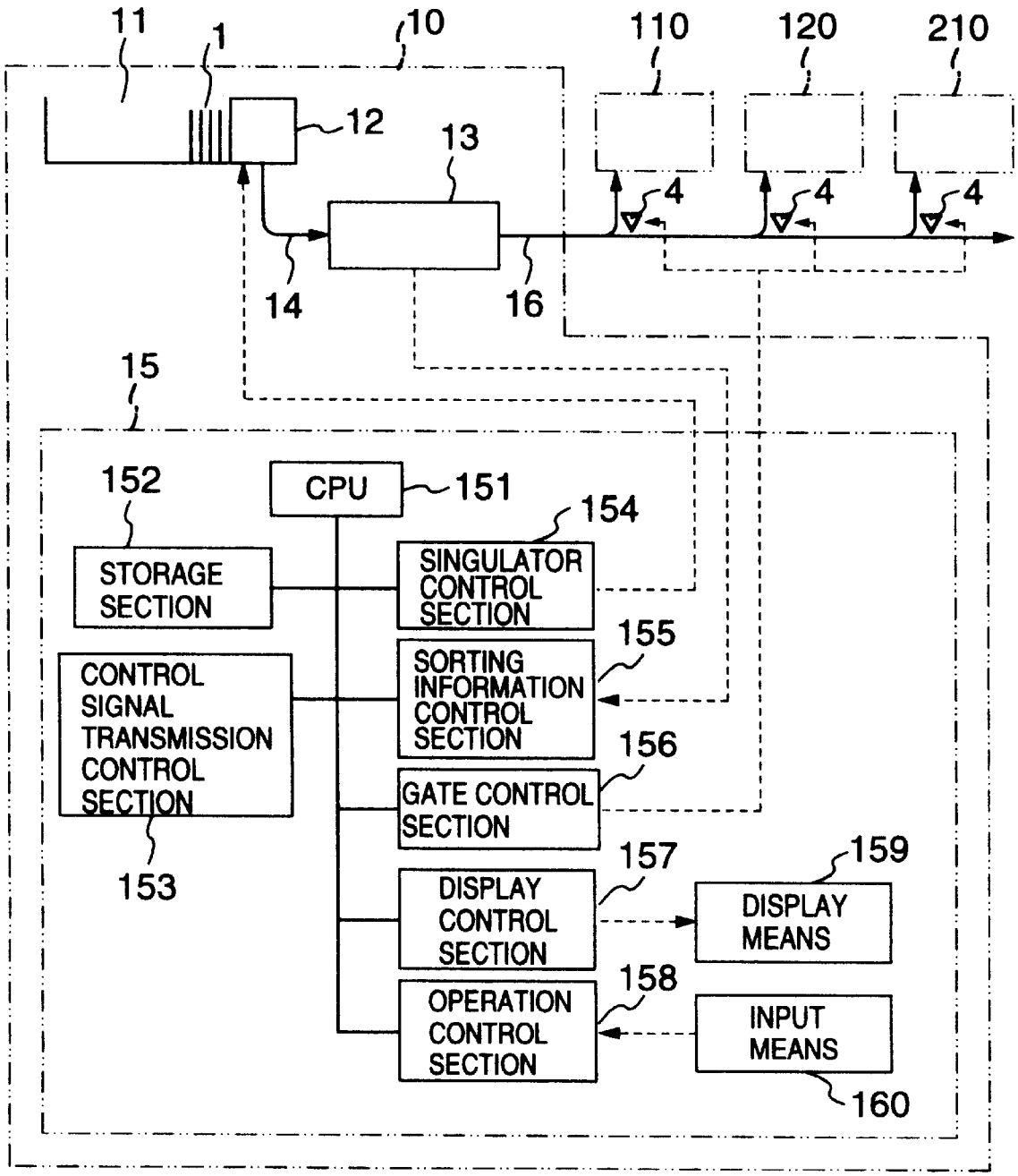
FIG. 5 is a block diagram showing the configuration of a supply means used in one embodiment of the sorter system according to this invention as well as one embodiment of the control means.
Figure 6:
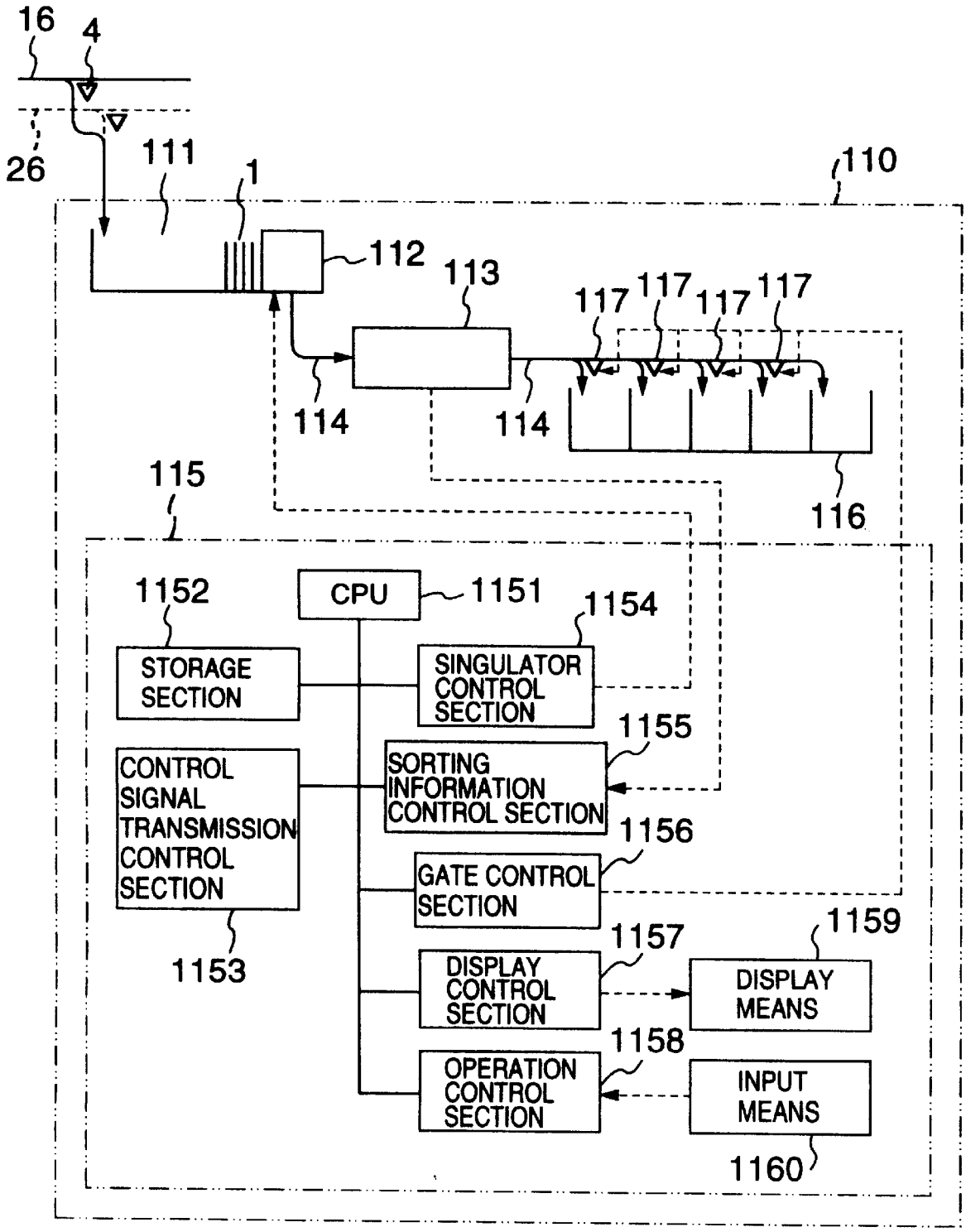
FIG. 6 is a block diagram showing the configuration of a sorter used in one embodiment of the sorter system according to this invention as well as one embodiment of the control means.

A first embodiment of this invention is described below with reference to FIGS. 1 to 6. FIG. 1 is a general block diagram showing one embodiment of a sorter system according to this invention. FIG. 2 is a perspective view showing a transfer and a gate means constituting the sorter system according to this invention. FIG. 3 is a perspective view showing one embodiment of a transfer means for changing the transfer direction. FIG. 4 is a block diagram showing one embodiment of a control means for controlling the sorter system according to this invention. FIG. 5 is a block diagram showing one embodiment of a control means for each supply means constituting part of the sorter system according to this invention. FIG. 6 is a block diagram showing one embodiment of the control means for each sorter constituting part of the sorter system according to this invention.

The general configuration of the sorter system according to this invention is described with reference to FIG. 1.

A plurality of supply means 10, 20, . . . supplies sheets 1 with sorting information attached thereto to a plurality of sorters 110, 120, . . . , 210, . . . according to the sorting information. Each of the supply means 10, 20, . . . has a hopper means 11, 21, . . . for setting sheets 1 to be processed. The hopper means 11, 21, . . . has at its end a singulating means 12, 22, . . . for separating the set sheets 1. The singulating means 12, 22, . . . has a transfer means 14, 24, . . . for transferring the separated sheets 1. The transfer means 14, 24, . . . has at its end a sorting information reading means 13, 23, . . . for reading the sorting information attached to the sheets 1. These devices and a control means 15, 25, . . . for controlling each of the supply means 10, 20, . . . constitute each of the supply means 10, 20, . . .

Although in this embodiment, each supply means 10, 20, . . . is shown to include the sorting information reading means 13, 23, . . . and the control means 15, 25, . . . , the sorting information reading means 13, 23, . . . and the control means 15, 25, . . . may be separated from the supply means 10, 20, . . .

Each supply means 10, 20, . . . is connected to all of the plurality of sorters 110, 120, . . . 210 by transfer means 16, 26, . . . that are independent of each other so that each supply means 10, 20, . . . can asynchronously transfer a sheet 1 and that are coupled together in such a way that any number of transfer means can be added or removed from the above transfer means as required. Each transfer means 16, 26, . . . is provided with a plurality of gate means 4 controlled according to the sorting information read by each sorting information reading means 13, 23, . . . , the gate means 4 through which the plurality of sorters 110, 120, . . . , 210, . . . are connected. The transfer means 16, 26, . . . having the gate means 4 can be configured so that any number of transfer means can be added or removed from them as required integrally with each sorter 110, 120, . . . 210, . . . or independently.

The sorter 110, 120, . . . , 210, . . . for sorting the sheets 1 transferred from the supply means 10, 20, . . . comprises the following means. Each sorter 110, 120, . . . 210, . . . has a hopper means 111, 121, . . . , 211, . . . for housing the sheets 1 transferred from the transfer means 16, 26 . . . The hopper means 111, 121, . . . , 211 has at its end a singulating means 112, 122, . . . , 212, . . . for separating the sheets 1. The singulating means 112, 122, . . . , 212, . . . has a transfer means 114, 124, . . . , 214, . . . for transferring the separated sheets 1. The transfer means 114, 124, . . . , 214, . . . has in its middle a sorting information reading means 113, 123, 213, . . . for reading the sorting information attached to the transferred sheets 1.

Each transfer means 114, 124, . . . , 214, . . . is provided with a plurality of gate means 117, 127, . . . , 217, . . . (only one of them is shown, and the others are omitted) controlled according to the sorting information read by each sorting information reading means 113, 123, . . . , 213, . . . , the gate means 117, 127, . . . , 217, . . . through which sorting shelves 116, 126, . . . , 216, . . . are connected. These means and a control means 115, 125, . . . 215, . . . for controlling each means in the above sorter 110, 120, . . . , 210, . . . constitute each of the sorters 110, 120, . . . , 210, . . .

Each transfer means 16, 26, . . . has a housing means 8, 9, . . . for housing sheets 1 that cannot be processed by the supply means 10, 20, . . .

The control means 15, 25, . . . provided in each supply means 10, 20, . . . and the control means 115, 125, . . . , 215, . . . provided in each sorter 110, 120, . . . , 210 are each connected to the control means 5 via a transmission means 6, and controlled by instructions from the control means 5.

FIG. 2 is a perspective view showing an example 1000 of the transfer means 16, 26, . . . or the transfer means 114, 124, . . . , 214, . . . , and the plurality of gate means 4 or the plurality of gate means 117, 127, . . . , 217, . . . , and is explained below by assuming that sheets 1 are transferred from arrow IN to arrow OUT. A transfer belt 1002 passed rotatably around a plurality of pulleys 1001 and a transfer belt 1004 passed rotatably around a plurality of pulleys 1003 are opposed to each other. A plurality of transfer belts 1002 and opposed transfer belts 1004 are disposed in the rotation axial direction of the pulleys 1001 and 1003, and a sheet 1 is sandwiched and transferred between the opposed faces of the transfer belts 1002 and 1004.

Although in this example, a transfer path is formed of a plurality of transfer belts, it may be formed of a pair of transfer belts. The transfer means 16, 26, . . . or the transfer means 114, 124, . . . , 214 are formed by sequentially connecting such transfer paths.

Furthermore, as shown in FIG. 2, if the transfer means has in its middle the gate means 4, the transfer belt 1002 passed rotatably around the plurality of pulleys 1001, the transfer belt 1004 passed rotatably around the plurality of pulleys 1003, the transfer belt 1006 passed rotatably around the plurality of pulleys 1005, and each transfer belt of the transfer belt 1008 passed rotatably around the plurality of pulleys 1007 are disposed in the rotation shaft direction of the pulley 1001, 1003, 1005, 1007 so that they are opposed to each other. On the upstream side of the gate means 4, the transfer belt 1002 and the transfer belt 1004 are opposed to each other to form a transfer path for sheets 1 (arrow IN in the figure). The transfer belt 1004 is disposed below the gate means and opposed to the transfer belt 1008 on one downstream side of the gate means 4 to form a transfer path for sheets 1 (arrow OUT 2 in the figure), while the transfer belt 1002 is opposed to the transfer belt 1006 on the other downstream side to form a transfer path for sheets 1 (arrow OUT 1 in the figure).

Although the details of the gate means 4 are not illustrated, one end of the gate means 4 has a rotation shaft below the transfer path formed by the transfer belt 1002 and the opposed transfer belt 1004, while its other end is rotatably provided so as to cross the transfer path formed by the transfer belt 1002 and the opposed transfer belt 1004 toward the upper side of the path. The other end of the gate means 4 is controlled by the control means 15, 25, . . . , 115, 125, . . . , 215, . . . , and if it is located on the same side of the transfer path formed by the transfer belt 1002 and the opposed transfer belt 1004 as the rotation shaft, sheets transferred from the direction of arrow IN in the figure are transferred to the direction of arrow OUT 1, whereas if it is located on that side of the transfer path formed by the transfer belt 1002 and the opposed transfer belt 1004 which is opposed to the rotation shaft, sheets transferred from the direction of arrow IN in the figure are transferred to the direction of arrow OUT 2.

FIG. 3 is a perspective view showing an example 2000 of a transfer means for changing the transfer direction to the direction of arrow OUT 2 in the example 1000 of the transfer and gate means. A transfer belt 2001 passed rotatably around pulleys 2006, 2004, 2005 and 2009 and a transfer belt 2002 passed rotatably around pulleys 2007, 2003, 2004, and 2008 are opposed to each other, and sheets 1 are sandwiched and transferred between the opposed faces of the transfer belts 2001 and 2002. A transfer path is formed so that among the rotation shafts of pulleys 2006 and 2007 opposed to each other, the rotation shafts of pulleys 2003, 2004, and 2005 opposed to one another, and the rotation shafts of pulleys 2008 and 2009 opposed to each other, the pairs of the rotation shafts of at least two pairs of opposed pulleys are arranged differently from each other so as to enable the transfer direction of the transfer path to be changed.

Sheets transferred from the direction of arrow IN in the figure are fed via the gate means 4 and the example 2000 of the transfer means for changing the transfer direction in such a way that the transfer direction is changed to the direction of arrow OUT 2.

The combination with the example 2000 of the transfer means for changing the transfer direction enables sheets to be transferred in an arbitrary direction.

FIG. 4 is a block diagram of the control means 5. The control means 5 comprises a CPU 500 for managing each section of the control means 5, a storage section 501 for storing processing procedures, a data storage section 502 for storing various data, a data transmission control section 503 for transmitting data to other devices, a control signal transmission control section 504 for controlling the transmission of control signals via the transmission means 6 to and from the control means 15, 25, . . . , and 115, 125, . . . , 215, . . . in the sorter system according to this invention, a display means 507 for displaying various information, a display control section 505 for controlling the display means 507, an input means 508 for inputting information to the control means 5, and an operation control section 506 for controlling the input means 508. The transmission means 6 may be a wire type, a wireless type, or their combination.

FIG. 5 shows one embodiment of the control means 15, 25, . . . in the supply means 10, 20, . . . This figure is a block diagram of the control means 15 in the supply means 10. The control means 15 comprises a CPU 151 for managing each section of the control means 15, a storage section 152 for storing processing procedures, a control signal transmission control section 153 for controlling the transmission of control signals via the transmission means 6 to and from the control means 55, 25, . . . , and 115, 125, . . . , 215, . . . in the sorter system according to this invention, a singulator control means 154 for controlling the singulating means 12, a sorting information control means 155 for controlling the sorting information reading means 13, a gate control section 156 for controlling the plurality of gate means 4 provided in the transfer means 16 according to the sorting information read by the sorting information reading means 13, a display means 159 for displaying various information, a display control section 157 for controlling the display means 159, an input means 160 for inputting information to the control means 15, and an operation control section 158 for controlling the input means 160.

FIG. 6 shows one embodiment of the control means 115, 125, . . . , 215, . . . in the sorter 110, 120, . . . , 210, . . . This figure is a block diagram of the control means 115 in the sorter 110. The control means 115 comprises a CPU 1151 for managing each section of the control means 115, a storage section 1152 for storing processing procedures, a control signal transmission control section 1153 for controlling the transmission of control signals via the transmission means 6 to and from the control means 5, 15, 25, . . . , and 125, . . . , 215, . . . in the sorter system according to this invention, a singulator control means 1154 for controlling the singulating means 112, a sorting information control means 1155 for controlling the sorting information reading means 113, a gate control section 1156 for controlling the plurality of gate means 117 provided in the transfer means 114 according to the sorting information read by the sorting information reading means 113, a display means 1159 for displaying various information, a display control section 1157 for controlling the display means 1159, an input means 1160 for inputting information to the control means 115, and an operation control section 1158 for controlling the input means 1160.

Next, the operations of the sorter system according to this invention, that is, the sorting and sequencing operations are described.

To use the sorter system according to this invention to perform a sorting operation, the indication that this is a sorting operation and the range of sorting information to be shared by each sorter 110, 120, . . . , 210, . . . are input from the input means 508 of the control means 5 in FIG. 1 or 4. The range of sorting information to be shared by each sorter 110, 120, . . . , 210, . . . may be stored in the storage section 501 in advance, and selected according to the contents of the sorting operation. Based on the information input from the input means 508, the indication that this is a sorting operation is transmitted to each of the control means 15, 25, . . . and 115, 125, . . . , 215, . . . , and the range of sorting information to be shared by each sorter 110, 120, . . . , 210, . . . is transmitted to each of the control means 115, 125, . . . , 215, . . . , via the control signal transmission control section 504 and transmission means 6 under instructions from the CPU 500. This information is then stored in the control means 115, 125, . . . , 215, . . .

The control means 15, 25, . . . in the supply means 10, 20, . . . in FIG. 1 or 5 receives information transmitted by the control means 5 via the transmission means 6. The processing within the control means 15, 25, . . . is then described with reference to the control means 15 in FIG. 5, but the following description is also applicable to the other control means 25, . . . The information transmitted to the control means 15 via the transmission means 6 is received by the control signal transmission control section 153 and stored in the storage section 152, and the CPU 151 controls each means for the sorting operation based on the information stored in the storage section 152. Likewise, the control means 115, 125, . . . , 215, . . . in the sorter 110, 120, . . . , 210, . . . in FIG. 1 or 6 receives information transmitted from the control means 5 via the transmission means 6.

The operation of the control means 115, 125, . . . , 215, . . . is then described with reference to the control means 115 in FIG. 6, but the following description is also applicable to the other control means 125, . . . , 215, . . . The information transmitted to the control means 115 via the transmission means 6 is received by the control signal transmission control section 1153 and stored in the storage section 1152, and the CPU 1151 controls each means for the sorting operation by defining the range of sorting information to be shared for each of the plurality of sorting shelves 116 based on the information stored in the storage section 1152.

Sheets 1 to be sorted are then set in the hopper 11, 21, . . . in the supply means 10, 20, . . . in FIG. 1 or 5. The sheets 1 set in the hopper 11, 21, . . . are separated by the singulating means 12, 22, . . . driven by control signals from the singulator control section 154 in the control section 15, 25, . . . The separated sheets 1 are fed by the transfer means 14, 24, . . . to the sorting information reading means 13, 23, . . . The sorting information attached to each sheet 1 is read by the sorting information reading means 13, 23, . . . , and loaded in the control means 15, 25, . . . via the sorting information control section 155, . . . The control means 15, 25, . . . compares the sorting information read by the sorting information reading means 13, 23, . . . and transmitted to the control means 15, 25, . . . via the sorting information control section 155, . . . to the sorting information to be shared by each sorter 110, 120, . . . , 210, . . . which has been transmitted by the control means 5 in order to determine the sorter 110, 120, . . . , 210, . . . to which the sheet 1 is to be transferred and to determine the driving conditions for the gate means 4 provided in the transfer means 16, 26, . . . which are required to transfer the sheet 1 to the sorter 110, 120, . . . , 210, . . . determined.

In response to this determination, the CPU 151 controls the gate means 4 provided in the transfer means 16, 26, . . . via the gate control section 156. The sheets 1 from which the sorting information has been read by the sorting information reading means 13, 23, . . . are transferred by the transfer means 16, 26, . . . and the gate means 4 to the respective specified sorters 110, 120, . . . , 210, . . . The remaining sheets 1 set in the hopper 11, 21, . . . are similarly processed and transferred to the respective specified sorters 110, 120, . . . , 210, . . .

The operation of the sorter 110, 120, . . . , 210, . . . is described with reference to the sorter 110 in FIG. 1 or 6, but the following description is also applicable to the other sorters 120, . . . , 210, . . .

The sheets 1 transferred from the transfer means 16, 26, . . . are stacked in the hopper means 111 in the sorter 110. The sheets 1 stacked in the hopper means 111 are separated by the singulating means 112 driven by control signals from the singulating control section 1154 in the control means 115.

The separated sheets 1 are fed by the transfer means 114 to the sorting information reading means 113. The sorting information attached to the sheets 1 is read by the sorting information reading means 113 and loaded in the control means 115 via the sorting information control section 1155.

The control means 115 compares the sorting information read by the sorting information reading means 113 and transmitted to the control means 115 via the sorting information control section 1155 to the sorting information to be shared which is defined for each of the plurality of sorting shelves 116 in order to determine the sorting shelf 116 in which the sheet is to be stacked and to control the gate means 117 in the transfer means 114. The sheets 1 from which the sorting information has been read by the sorting information reading means 113 are stacked in a specified one of the plurality of sorting shelves 116 by the transfer means 114 and gate means 117. In this manner, the sorting shelves 116, 126, . . . , 216, . . . in the sorters 110, 120, . . . , 210, . . . can be used to perform the sorting operation according to the sorting information of the sheets 1.

Next, the sheet sequencing operation is described.

To use the sorter system according to this invention to perform a sequencing operation, the indication that this is a sequencing operation and the range of sorting information to be sequenced are input from the input means 508 of the control means 5 in FIG. 1 or 4. The range of sorting information to be sequenced may be stored in the storage section 501 in advance, and selected according to the contents of the sequencing operation.

Based on the information input from the input means 508, the indication that this is a sorting operation is transmitted to each of the control means 15, 25, . . . and 115, 125, . . . , 215, . . . , and the range of sorting information to be sequenced and shared by each sorter 110, 120, . . . , 210, . . . is transmitted to each of the control means 115, 125, . . . , 215, . . . , via the control signal transmission control section 504 and transmission means 6 under instructions from the CPU 500. This information is then stored in the control means 115, 125, . . . , 215, . . .

The control means 15, 25, . . . in the supply means 10, 20, . . . in FIG. 1 or 5 receives information transmitted by the control means 5 via the transmission means 6. The processing within the control means 15, 25, . . . is then described with reference to the control means 15 in FIG. 5, but the following description is also applicable to the other control means 25, . . . The information transmitted to the control means 15 via the transmission means 6 is received by the control signal transmission control section 153 and stored in the storage section 152, and the CPU 151 controls each means for the sorting operation based on the information stored in the storage section 152. Likewise, the control means 115, 125, . . . , 215, . . . in the sorter 110, 120, . . . , 210, . . . in FIG. 1 or 6 receives information transmitted from the control means 5 via the transmission means 6.

The operation of the control means 115, 125, . . . , 215, . . . is then described with reference to the control means 115 in FIG. 6, but the following description is also applicable to the other control means 125, . . . , 215, . . . The information transmitted to the control means 115 via the transmission means 6 is received by the control signal transmission control section 1153 and stored in the storage section 1152.

Sheets 1 to be sorted are then set in the hopper 11, 21, . . . in the supply means 10, 20, . . . in FIG. 1 or 5. The sheets 1 set in the hopper 11, 21, . . . are separated by the singulating means 12, 22, . . . driven by control signals from the singulator control section 154 in the control section 15, 25, . . . The separated sheets 1 are fed by the transfer means 14, 24, . . . to the sorting information reading means 13,23, . . . The sorting information attached to each sheet 1 is read by the sorting information reading means 13, 23, . . . , and loaded in the control means 15, 25, . . . via the sorting information control section 155, . . . The control means 15, 25, . . . compares the sorting information read by the sorting information reading means 13, 23, . . . and transmitted to the control means 15, 25, . . . via the sorting information control section 155, . . . to the range of sorting information to be sequenced by each sorter 110, 120, . . . , 210, . . . which has been transmitted by the control means 5 in order to determine the sorter 110, 120, . . . , 210, . . . to which the sheet 1 is to be transferred and to determine the driving conditions for the gate means 4 provided in the transfer means 16, 26, . . . which are required to transfer the sheet 1 to the sorter 110, 120, . . . , 210, . . . determined.

In response to this determination, the CPU 151 controls the gate means 4 provided in the transfer means 16, 26, . . . via the gate control section 156. The sheets 1 from which the sorting information has been read by the sorting information reading means 13, 23, . . . are transferred by the transfer means 16, 26, . . . and the gate means 4 to the respective specified sorters 110, 120, . . . , 210, . . . The remaining sheets 1 set in the hopper 11, 21, . . . are similarly processed. After ensuring that all the sheets have been transferred to the respective specified sorters 110, 120, . . . , 210, . . . , the operator inputs the starting of the sequencing operation from the input means 508 of the control means 5.

This information on the starting of the sequencing operation is transmitted to the control means 115, 125, . . . , 215 for each sorter 110, 120, . . . , 210, . . . from the control means 5 via the transmission means 6 as described above. The sequencing operation in the sorter 110, 120, . . . , 210, . . . is described with reference to the sorter 110 in FIG. 1 or 6, but the following description is also applicable to the other sorters 120, . . . , 210, . . .

The range of sorting information to be sequenced is stored in the control means 115 in the sorter 110 in advance, as described above. Each piece of sorting information contained in the range of sorting information is numbered in the order that the pieces of information are to be sequenced. These numbers are then stored in the storage section 1152. The process of numbering each piece of sorting information and storing the numbers in the storage section can be carried out after the range of sorting information to be sequenced has been transmitted to each control means.

For simplicity of description, it is assumed that the plurality of sorting shelves 116 comprise ten sorting shelves and that the sorting information comprises 100 pieces of information and is equivalent for the numbers 0 to 99. The operator first confirms through the display means 1159 the information on the starting of the sequencing operation, and then inputs the starting of the sequencing operation from the input means 1160 of the control means 115. The CPU 1151 sees only the units digits of the numbers 0 to 99 attached to the pieces of sorting information to define the number 0 to 9 for the 10 sorting shelves 116.

Sheets 1 stacked in the hopper means 110 are separated by the singulating means 112 driven by control signals from the singulating section 1154 in the control means 115. The separated sheets 1 are fed by the transfer means 114 to the sorting information reading means 113. The sorting information attached to the sheets 1 is read by the sorting information reading means 113 and loaded in the control means 115 via the sorting information control section 1155. The control means 115 compares the units digits 0 to 9 of the numbers for sequencing which correspond to the sorting information read by the sorting information reading means 113 to the units digits 0 to 9 defined for the ten sorting shelves 116 in order to determine the sorting shelf 116 to which the sheet 1 is to be transferred and to determine the driving conditions for the gate means 117 provided in the transfer means 114 which are required to transfer the sheet 1 to the sorting shelf 116 determined.

In response to this determination, the CPU 1151 controls via the gate control section 1156 the gate means 117 provided in the transfer means 114. The sheets 1 from which the sorting information has been read by the sorting information reading means 13 are transferred by the transfer means 114 and gate means 117 to the respective specified sorting shelves 116. The remaining sheets 1 set in the hopper 111 are similarly processed. After ensuring that all the sheets have been transferred to the respective specified sorting shelves 116, the operator inputs the stopping of each means of the sorter 110 from the input means 1160 of the control means 115 to stop each means.

The sheets 1 with units digits 0 to 9 have been sorted and stacked in the respective sorting shelves 116. The operator sequentially takes out the sheets 1 from the sorting shelf 116 with a units digit of 9 and resets them on the singulating means 112 side of the hopper 111. Likewise, the operator sequentially takes out the sheets 1 from the sorting shelves 116 with units digits 8 to 0 and resets them on the side of the hopper 111 opposed to the singulating means 112. Once the resetting has been finished, the operator inputs restarting from the input means 1160 of the control means 115. The CPU 1151 then sees only the tens digits of the numbers 0 to 99 attached to the sorting information, and defines these numbers 0 to 9 for the sorting shelves 116. As in the units digits, the sheets 1 reset in the hopper 110 are separated by the singulating means 112 driven by control signals from the singulating control section 1154 of the control means 115.

The separated sheets 1 are transferred by the transfer means 114 to the sorting information reading means 113. The sorting information attached to the sheets 1 is read by the sorting information reading means 113 and loaded in the control means 115 via the sorting information control section 1155. The control means 115 compares the tens digits of the numbers for sequencing which correspond to the sorting information read by the sorting information reading means 113 to the tens digits 0 to 9 defined for the ten sorting shelves 116 described above in order to determine the sorting shelf 116 to which the sheet 1 is to be transferred and to determine the driving conditions for the gate means 117 provided in the transfer means 114 which are required to transfer the sheet 1 to the sorting shelf 116 determined.

In response to this determination, the CPU 1151 controls via the gate control section 1156 the gate means 117 provided in the transfer means 114. The sheets 1 from which the sorting information has been read by the sorting information reading means 13 are transferred by the transfer means 114 and gate means 117 to the respective specified sorting shelves 116. The remaining sheets 1 set in the hopper 111 are similarly processed. After ensuring that all the sheets 1 have been transferred to the respective specified sorting shelves 116, the operator inputs the stopping of each means of the sorter 110 from the input means 1160 of the control means 115 to stop each means.

The sheets 1 with tens digits 0 to 9 have been sorted and stacked in the respective sorting shelves 116. As described above, the sheets 1 with the units digits 9 to 0 have been sequentially reset in the hopper 111 and are to be processed in this order, so the sheets 1 with the units digits 9 to 0 are sequentially stacked in the respective sorting shelves 116. The sheets 1 can be sequenced in a specified order by sequentially taking out the sheets 1 in the sorting shelf 116 defined with a tens digit of 0 from the sorting shelf 116 defined with a tens digit 9.

Although the above example has been described in conjunction with the assumption that the sorting information comprises 100 pieces of information, a similar sequencing operation can be performed by carrying out a sorting operation a certain number of times equal to the number of the digits of the total number of pieces of information. In addition, although in the above method, the operator sequentially takes out the sheets 1 from the sorting shelves 116 and sets them in the hopper 111 in each sorting operation corresponding to each digit, the operation of taking out the sheets from the sorting shelves can be automated. The operator may also stop the apparatus after detecting that all the sheets 1 set in the hopper 111 have been separated.

As described above, the embodiment of the sorter system according to this invention can sort and sequence the sheets 1 with the sorting information attached thereto.

Figure 7:
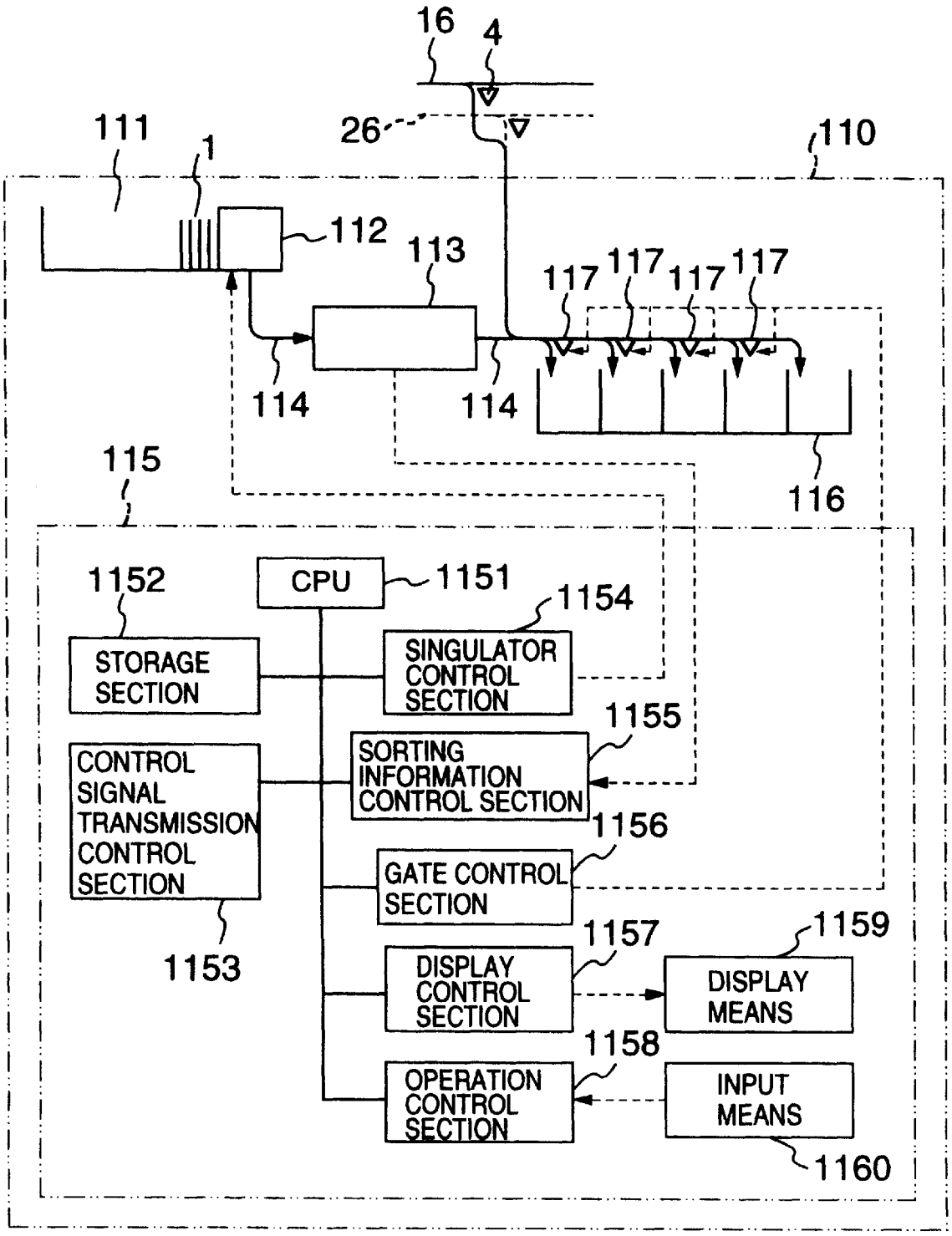
FIG. 7 is a block diagram showing the configuration of a sorter used in one embodiment of the sorter system according to this invention as well as another embodiment of the control means.

FIG. 7 shows another embodiment of the sorter and control means constituting this invention. This embodiment relates to the location in which the sheets 1 transferred through the transfer paths 16, 26, . . . to the sorter 110 in FIG. 6 are loaded in the sorter 110. In this configuration, the transfer means 16, 26, . . . for transferring the sheets 1 to the sorter 110 via the gate means 4 provided in the transfer means 16, 26, . . . meet each other between the gate means 4 and the sorter 110 to form the single transfer means 16. The transfer means 16 meets the transfer means 114 between the sorting information reading means 113 and the first gate means 117 provided between the sorting information reading means 113 and the sorting shelf 116 so that the sheets 1 transferred from the transfer paths 16, 26, . . . can be directly stacked in the sorting shelves 116. The operation performed when each sorter 110, 120, . . . , 210, . . . in FIG. 1 comprises the sorter shown in FIG. 7 is described by presenting only the difference between this operation and the operation of the above embodiment.

To perform a sorting operation, the indication that this is a sorting operation transferred by the control means 5 via the transmission means 6, the order of driving the supply means 10, 20, . . . , and the range of sorting information to be shared by each sorter 110, 120, . . . , 210, . . . are stored in each control means 115, 125, . . . , 215, . . . Although the operation of each sorter 110, 120, . . . , 210, . . . is described with reference to the sorter 110 in FIG. 7, the following description is applicable to the other sorters 120, . . . , 210, . . . Based on the range of sorting information to be shared by the sorter 110 which is stored in the control means 115 of the sorter 110, the sorting information to be shared by each sorting shelf 116 of the sorter 110 is defined and stored in the storage section 1152.

The sheets 1 separated by the singulating means 12 in the supply means 10 are fed by the transfer means 14 to the sorting information reading means 13. The sorting information attached to each sheet 1 is read by the sorting information reading means 13 and loaded in the control means 15 via the sorting information control section 155. The control means 15 transmits the sorting information to the control means 115, 125, . . . , 215, . . . for the corresponding sorters 110, 120, . . . , 210, . . . , and compares the sorting information read by the sorting information reading means 13 and transmitted to the control means 15 via the sorting information control section 155 to the sorting information to be shared by the sorter 110 which has been transmitted by the control means 5 in order to determine the sorter 110, 120, . . . , 210, . . . to which the sheet 1 is to be transferred and to determine the driving conditions for the gate means 4 provided in the transfer means 16, which are required to transfer the sheet 1 to the sorter 110, 120, . . . , 210, . . . determined.

In response to this determination, the CPU 151, . . . controls the gate means 4 provided in the transfer means 16 via the gate control section 156, . . . The sheets 1 from which the sorting information has been read by the sorting information reading means 13 are transferred by the transfer means 16 and gate means 4 to the respective specified sorters 110, 120, . . . , 210, . . . that each comprises the sorter 110 shown in FIG. 7. The operation of the sorter 110, 120, . . . , 210, . . . is described with reference to the sorter 110 in FIG. 7 but the following description is also applicable to the other sorters 120 , . . . , 210, . . . The sorting information transmitted to the control means 115 for sorter 110 is compared to the sorting information to be shared by the sorting shelf 116 which is stored in the storage section 1152 in order to determine the sorting shelf 116 to which the sheet 1 is to be transferred and to determine the driving conditions for the gate means 117 provided in the transfer means 114 which are required to transfer the sheet 1 to the sorting shelf 116 determined.

In response to this determination, the CPU 1151 controls the gate means 117 provided in the transfer means 114 via the gate control section 1156. The sheets 1 transferred from the transfer means 16 are stacked in the respective specified sorting shelves 116 by the transfer means 114 in the sorter 110 via the gate means 17. The remaining sheets 1 set in the hopper 11 are similarly processed to achieve the sorting operation. After all the sheets 1 set in the hopper 11 have been processed, the indication that the sorting has been finished is transmitted by the control means 15 to the control means 5 and the other supply means 25, . . . via the transmission means 6. If there are sheets 1 set in the hopper means 21 in other supply means 20, . . ., these supply means 20 are driven to sort the sheets 1 as in the supply means 10. In this manner, the sheets 1 in all the supply means 10, 20, . . . can be sorted.

Next, the sequencing operation is described. Only the difference between this operation and the sequencing operation of the above embodiment, however, is referred to. The indication that this is a sequencing operation executed from the control means 5, the order of driving the supply means 10, 20, . . ., and the range of sorting information to be shared by each sorter 110, 120, . . . , 210, . . . are stored in each control means 115, 125, . . . , 215, . . . that comprise the sorter 110 shown in FIG. 7. As in the sequencing operation of the above embodiment, for simplicity of description, in the sorter 110 it is assumed before starting the sequencing operation of this invention that the plurality of sorting shelves 116 comprise ten sorting shelves and that the sorting information comprises 100 pieces of information. Only the units digits of the numbers 0 to 99 attached to the pieces of sorting information are noted to define the number 0 to 9 for the 10 sorting shelves 116.

After the sorting operation has been finished, the starting of the sequencing operation is input from the input means 508 of the control means 5. Since in the sorting operation of this embodiment, the sorting for the units digits for the sequencing operation has been finished, the sequencing operation of this embodiment can be started with the sequencing operation for the tens digits. In this manner, the sheets 1 can be sequenced in the sorters 110, 120, . . . , 210, . . .

As described above, the sorter system according to this invention can sort and sequence the sheets 1 with the sorting information attached thereto.

Figure 8:
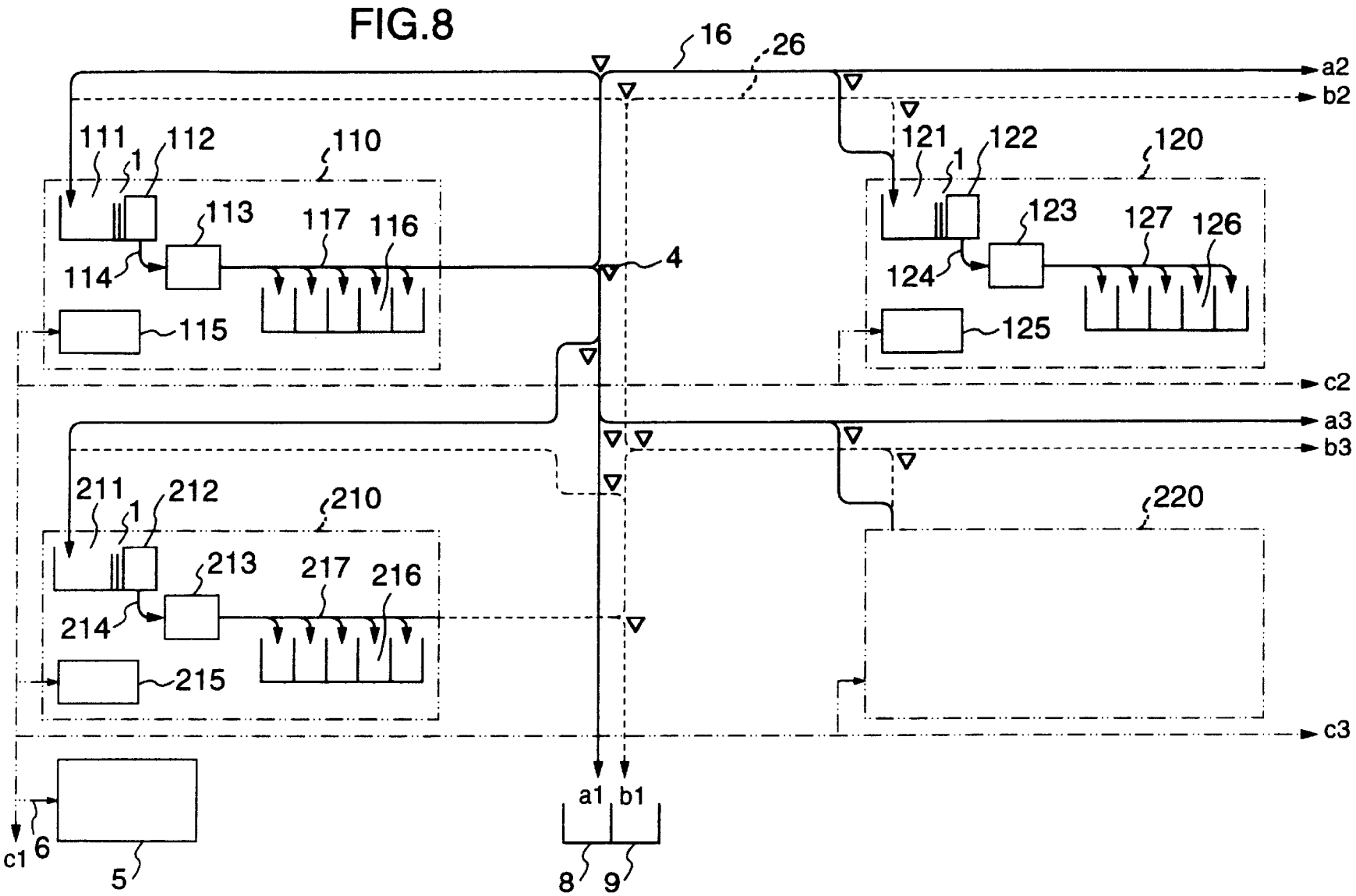
FIG. 8 is a general block diagram showing another embodiment of the sorter system according to this invention.

FIG. 8 shows another embodiment of the sorter system according to this invention. In this sorter system, some of the sorters 110, 120, . . . , 210, . . . comprise the supply sections 10, 20, . . . in FIG. 1. This configuration is described below.

In FIG. 8, the plurality of sorters 110, 210, . . . play the same role as the plurality of supply means 10, 20, . . . in the sorter system of the first embodiment in FIG. 1, and the other plurality of sorters 120, 220, . . . correspond to the plurality of sorters in the sorter system of the first embodiment in FIG. 1.

The plurality of sorters 110, 210, . . . supply the sheets 1 with the sorting information attached thereto to the plurality of sorters 110, 120, . . . , 210, 220, . . . according to the information. The sorters 110, 210, . . . each have a hopper means 111, 211, . . . for setting the sheets 1 to be processed.

The hopper means 111, 211, . . . has at its end a singulating means 112, 212, . . . for separating the set sheets 1. The singulating means 112, 212, . . . has a transfer means 114, 214, . . . for transferring the separated sheets 1. The transfer means 114, 214, . . . has at its end a sorting information reading means 113, 213, . . . for reading the sorting information attached to the transferred sheets 1.

Each transfer means 114, 214, . . . is provided with a plurality of gate means 117, 217, . . . (only one of them is shown, and the others are omitted) controlled according to the sorting information read by each sorting information reading means 113, 213, . . . , the gate means 117, 217, . . . through which sorting shelves 116, 126, . . . , 216, . . . are connected. These devices and control means 115, 215, . . . for controlling each means in the sorter 110, 210, . . . constitute each sorter 110, 210, . . .

The transfer means 114, 214, . . . in the sorter 110, 210, . . . are connected to all of the plurality of sorters 110, 210, . . . , 120, 220, . . . and to the transfer means 16, 26, . . . that are independent of each other so that each sorters 110, 210 . . . can asynchronously transfer a sheet 1 and that are coupled together in such a way that any number of transfer means can be added or removed from the above transfer means as required. Each transfer means 16, 26, . . . is provided with a plurality of gate means 4 controlled according to the sorting information read by each sorting information reading means 13, 23, . . . , the gate means 4 through which the plurality of sorters 110, 120, . . . , 210, 220, . . . are connected.

The sorter 120, . . . , 220, . . . for sorting the sheets 1 transferred from the sorter 110, 210, . . . comprises the following means. Although the sorter 120 is described as an example, the following description is applicable to the other sorters.

The sorter 120 has a hopper means 121 for housing the sheets 1 transferred from the transfer means 16, 26, . . . The hopper means 121 has at its end a singulating means 122 for separating the sheets 1. The singulating means 122 has a transfer means 124 for transferring the separated sheets 1. The transfer means 124 has in its middle a sorting information reading means 123 for reading the sorting information attached to the transferred sheets 1.

The transfer means 124 is provided with a plurality of gate means 127 (only one of them is shown, and the others are omitted) controlled according to the sorting information read by the sorting information reading means 123, the gate means 127 through which sorting shelves 126 are connected. These means and a control means 125 for controlling each means in the above sorter 120 constitute the sorter 120.

Each transfer means 16, 26, . . . has a housing means 8, 9, . . . for housing sheets 1 that cannot be processed by the sorter 110, 210, . . .

The control means 115, 215, . . . , 125, . . . provided in the sorters 110, 210, . . . , 120, 220, . . . are each connected to the control means 5 via a transmission means 6, and controlled by instructions from the control means 5. The perspective view in FIG. 2 showing an example 1000 of the transfer means 16, 26, . . . or the transfer means 114, 124, . . . , 214, . . . , and the plurality of gate means 4 or the plurality of gate means 117, 217, . . . , and the perspective view in FIG. 3 showing an example 2000 of the transfer means for changing the transfer direction are also applicable to this embodiment.

A block diagram of the control means 5 is as shown in FIG. 4 for the above embodiment, and a block diagram of the control means 115, 215, . . . , 125, . . . for the sorter 110, 210, . . . , 120, . . . is as shown in FIG. 6 for the above embodiment.

The operations of the embodiments of the above sorter system of this invention, that is, the sorting and sequencing operations are described below.

To use the sorter system according to this invention to perform a sorting operation, the indication that this is a sorting operation and the range of sorting . . . , information to be shared by each sorter 110, 120, 210, . . . are input from the input means 508 of the control means 5 in FIG. 8 or 4. The range of sorting . . . , information to be shared by each sorter 110, 120, 210, . . . may be stored in the storage section 501 in advance, and selected according to the contents of the sorting operation.

Based on the information input from the input means 508, the indication that this is a sorting operation and the range of sorting information to be shared by each sorter 110, 210, . . . , 120 are transmitted to each of the control means 115, 215, . . . , 125 via the control signal transmission control section 504 and transmission means 6 under instructions from the CPU 500. This information is then stored in the control means 115, 215, . . . , 125, . . .

The control means 115, 215, . . . 125, . . . in the sorter 110, 210, . . . , 120, . . . in FIG. 8 or 6 receives information transmitted by the control means 5 via the transmission means 6. The processing within the control means 115, 215, . . . for the sorter 110, 210, . . . is then described with reference to the control means 115 in FIG. 6, but the following description is also applicable to the other control means 215, . . .

The information transmitted to the control means 15 via the transmission means 6 is received by the control signal transmission control section 153 and stored in the storage section 1152, and the CPU 1151 controls each means for the sorting operation by defining the range of sorting information to be shared by each of the plurality of sorting shelves 116 and the sorting information to be transferred by the transfer means 16 to the other sorters 210, . . . , 120 based on the information stored in the storage section 1152. The operation of the control means 125, . . . for the sorter 120, . . . is the same as that of the control means 115 in FIG. 6 except that in the latter embodiment, the sorting information to be transferred by the transfer means 16 to the other sorters 210, . . . , 120, . . . is not defined.

Sheets 1 to be sorted are then set in the hopper 111, 211, . . . in the sorter 110, 210, . . . in FIG. 8 or 6. The sheets 1 set in the hopper 111, 211, . . . are separated by the singulating means 112, 212, . . . driven by control signals from the singulator control section 1154 in the control section 115, 215, . . . The separated sheets 1 are fed by the transfer means 114, 214, . . . to the sorting information reading means 113, 213, . . . The sorting information attached to each sheet 1 is read by the sorting information reading means 113, 213, . . . , and loaded in the control means 115, 215, . . . via the sorting information control section 1155, . . .

The control means 115, 215, . . . compares the sorting information read by the sorting information reading means 113, 213, . . . and transmitted to the control means 115, 215, . . . via the sorting information control section 1155, . . . to the sorting information to be shared by each sorter 110, 210, . . . , 120, . . . which has been transmitted by the control means 5 in order to determine the sorter 110, 210, . . . , 120, . . . to which the sheet 1 is to be transferred and to determine the driving conditions for the gate means 117, 217, . . . provided in the transfer means 114, 214, . . . and the gate means 4 provided in the transfer means 16, 26, . . . which are required to transfer the sheet 1 to the sorter 110, 210, . . . , 120, . . . determined.

In response to this determination, the CPU 1151 controls the gate means 117, 217, . . . provided in the transfer means 114, 214, . . . and the gate means 4 provided in the transfer means 16, 26, . . . via the gate control section 1156. The sheets 1 from which the sorting information has been read by the sorting information reading means 113, 213, . . . are transferred by the transfer means 114, 214, . . . and the gate means 117, 217, . . . and the transfer means 16, 26, . . . and the gate means 4 to the respective specified sorting shelves 116, 216, . . . and the sorters 110, 210, . . . , 120, . . . The remaining sheets 1 set in the hopper 111, 211, . . . are similarly processed and transferred to the respective specified sorting shelves 116, 216, . . . and the sorters 110, 120, . . . , 210, . . .

The operation of the sorter 110, 120, . . . , 210, . . . is described with reference to the sorter 110 in FIG. 8 or 6, but the following description is also applicable to the other sorters 120, . . . , 210, . . . The sheets 1 transferred from the transfer means 16, 26, . . . are stacked in the hopper means 111 in the sorter 110. The sheets 1 stacked in the hopper means 111 are separated by the singulating means 112 driven by control signals from the singulating section 1154 in the control means 115. The separated sheets 1 are fed by the transfer means 114 to the sorting information reading means 113. The sorting information attached to the sheets 1 is read by the sorting information reading means 113 and loaded in the control means 115 via the sorting information control section 1155.

The control means 115 compares the sorting information read by the sorting information reading means 113 and transmitted to the control means 115 via the sorting information control section 1155 to the sorting information to be shared which is defined for each of the plurality of sorting shelves 116 in order to determine the sorting shelf 116 in which the sheet is to be stacked and to control the gate means 117 provided in the transfer means 114. The sheets 1 from which the sorting information has been read by the sorting information reading means 113 are stacked in a specified one of the plurality of sorting shelves 116 by the transfer means 114 and gate means 117. In this manner, the sorting shelves 116, 126, . . . , 216, . . . in the sorters 110, 120, . . . , 210, . . . can be used to perform the sorting operation according to the sorting information of the sheets 1.

Next, the sheet sequencing operation is described. Only the difference between this operation and the operation of the first embodiment is referred to by assuming as in the first embodiment that the plurality of sorting shelves 116 in the sorter 110, 210, . . . , 120, . . . comprises ten sorting shelves and that the sorting information comprises 100 pieces of information and is equivalent for the numbers 0 to 99.

To use the sorter system according to this invention to perform a sequencing operation, the indication that this is a sequencing operation and the range of sorting information to be sequenced are input from the input means 508 of the control means 5 in FIG. 8 or 4. Based on the information input from the input means 508, the indication that this is a sequencing operation and the range of sorting information to be sequenced and shared by each sorter 110, 210, . . . , 120, . . . are transmitted to each of the control means 115, 215, . . . , 125, . . ., via the control signal transmission control section 504 and transmission means 6 under instructions from the CPU 500. This information is then stored in the control means 115, 215, . . . , 125, . . .

The control means 115, 215, . . . , 125, . . . in the sorter 110, 210, . . . , 120, . . . in FIG. 8 or 6 receives information transmitted by the control means 5 via the transmission means 6. The processing within the control means 115, 215, . . . in the sorter 110, 210, . . . is then described with reference to the control means 115 in FIG. 6, but the following description is also applicable to the other control means 215, . . . The information transmitted to the control means 115 via the transmission means 6 is received by the control signal transmission control section 153 and stored in the storage section 1152, and the CPU 1151 controls each means for the sequencing operation by defining the range of sorting information to be shared by each of the plurality of sorting shelves 116 and the sorting information to be transferred by the transfer means 16 to the other sorters 210, . . . , 120, . . . based on the information stored in the storage section 1152. The CPU 1151 sees only the units digits of the numbers 0 to 99 attached to the pieces of sorting information to define the number 0 to 9 for the 10 sorting shelves 116.

The operation of the control means 125, . . . for the sorter 120, . . . is the same as that of the control means 115 in FIG. 6 except that in the latter embodiment, the sorting information to be transferred by the transfer means 16 to the other sorters 210, . . . , 120, . . . is not defined.

Sheets 1 to be sequenced are then set in the hopper 111, 211, . . . in the sorter 110, 210, . . . in FIG. 8 or 6. The sheets 1 set in the hopper 111, 211, . . . are separated by the singulating means 112, 212, . . . driven by control signals from the singulator control section 1154, . . . in the control section 115, 215, . . .

The separated sheets 1 are fed by the transfer means 114, 214, . . . to the sorting information reading means 113, 213, . . . The sorting information attached to each sheet 1 is read by the sorting information reading means 113, 213, . . . , and loaded in the control means 115, 215, . . . via the sorting information control section 1155, . . .

The control means 115, 215, . . . compares the sorting information read by the sorting information reading means 113, 213, . . . and transmitted to the control means 115, 215, . . . via the sorting information control section 115, 215, . . . to the sorting information to be sequenced by each sorter 110, 210, . . . , 120, . . . which has been transmitted by the control means 5 in order to determine the sorting shelf 116, 216, . . . in the sorter 110, 210, . . . as well as the sorter 120, . . . to which the sheet 1 is to be transferred and to determine the driving conditions for the gate means 117, 217, . . . provided in the transfer means 114, 214, . . . and the gate means 4 provided in the transfer means 16, 26, . . . which are required to transfer the sheet 1 to the sorting shelf 116, 216, . . . in the sorter 110, 210, . . . or the sorter 210, . . . determined.

In response to this determination, the CPU 1151 controls the gate means 117, 217, . . . provided in the transfer means 114, 214, . . . and the gate means 4 provided in the transfer means 16, 26, . . . via the gate control section 1156. The sheets 1 from which the sorting information has been read by the sorting information reading means 113, 213, . . . are transferred by the transfer means 114, 214, . . . and the gate means 117, 217, . . . and the transfer means 16, 26, . . . and the gate means 4 to the respective specified sorting shelves 116, 216, . . . and sorters 110, 210, . . . , 120, . . .

The remaining sheets 1 set in the hopper 111, 211, . . . are similarly processed and transferred to the respective specified sorting shelves 116, 216, . . . and sorters 110, 210, . . . , 120, . . .

After ensuring that all the sheets have been transferred to the respective specified sorting shelves 116, 216, . . . or sorters 210, . . . , the operator inputs the starting of the sequencing operation from the input means 508 of the control means 5. The sheets 1 for which the sorting with the units digits 0 to 9 of the sorting information has been finished is stacked in the sorting shelves 116, 216, . . . in the sorter 110, 210, . . . , and the sheets 1 transferred from the transfer means 16, 26, . . . is stacked in the hopper means 121, . . . in the sorter 120, . . . The sequencing operation described in the first embodiment for the sorter 110, 210, . . . , 120, . . . can be performed to sequence the sheets 1 in a specified order.

As described above, this embodiment can sort and sequence the sheets with the sorting information attached thereto.

It is also possible to combine the embodiment shown in FIG. 8 with the embodiment shown in FIG. 7.

Figure 9:
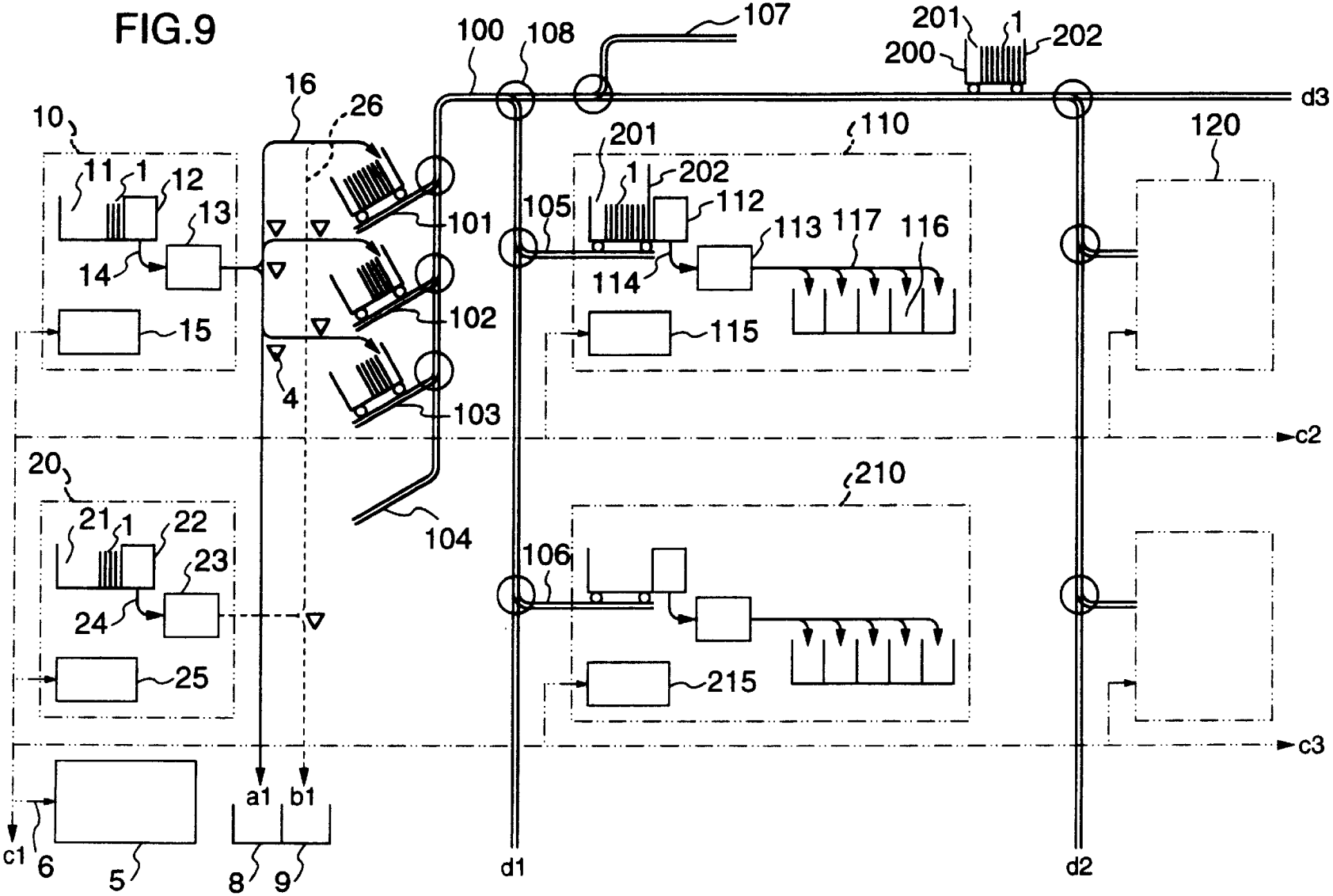
FIG. 9 is a general block diagram showing yet another embodiment of the sorter system according to this invention.

FIG. 9 is a general block diagram of another embodiment of the sorter system according to this invention. In this figure, a plurality of supply means 10, 20, . . . have a configuration similar to that in the first embodiment.

The sorters 13, 23, . . . of each supply means 10, 20, . . . is connected to all of the plurality of movable hopper means 200 staying stationary in place in a plurality of standby guide paths 101, 102, 103, 104, . . . by the transfer means 16, 26, . . . that are independent of each other so that each supply means 10, 20, . . . can asynchronously transfer a sheet 1 and that are coupled together in such a way that any number of transfer means can be added or removed from the above transfer means as required.

Each transfer means 16, 26, . . . is provided with a plurality of gate means 4 controlled according to the sorting information of the sheets 1 read by each sorting information reading means 13, 23, . . . , the gate means 4 through which the connections are made so that the sheets can be stacked in the plurality of movable hopper means 200 staying stationary in place in a plurality of standby guide paths 101, 102, 103, 104, . . . of the guide path 100. Each transfer means 16, 26, . . . has a housing means 8, 9, . . . for housing sheets 1 that cannot be processed by the supply means 10, 20, . . .

The movable hopper means 200 has an opening and closing shutter means 202 on its sorter 110, 210, . . . side in its travelling direction, and has inside a push plate means 201 for stacking the sheets 1 transferred from the transfer means 16, 26, . . . or pushing them out in the direction of the opening and closing shutter means 202.

The movable hopper means 200 is adapted to be guided along the guide path 100 by control signals from the control means 5 to move among the supply means 10, 20, . . . and sorter 110, 210, . . . The guide path 100 includes a plurality of standby guide path 101, 102, 103, 104, . . . for stacking in the hopper means 200 the sheets 1 transferred by the transfer means 16, 26, . . . from the supply means 10, 20 . . . , a plurality of guide switching means 108 for switching the guiding direction for the movable hopper 200, a plurality of escape guide paths 107 for allowing the movable hopper means 200 to escape from the guide path 100, and a plurality of draw-in guide paths 105, 106, . . . for drawing the movable hopper means 200 into the singulating means 112 in the sorter 110, 210, . . .

The configuration of the sorter 110, 210, . . . is described with reference to the sorter 110, but the following description is also applicable to the other sorters 210 . . . The sorter 110 has a singulating means 112 for separating the sheets 1 transferred by the movable hopper means 200 drawn into the draw-in guide path 105. The singulating means 112 has a transfer means 114 for transferring the separated sheets 1. The transfer means 114 has in its middle a sorting information reading means 113 for reading the sorting information attached to the transferred sheets 1. The transfer means is provided with a plurality of gate means 117 (only one of them is shown, and the others are omitted) controlled according to the sorting information read by the sorting information reading means 113, the gate means 117 through which the plurality of sorting shelves 116 are connected. These means and a control means 115 for controlling each means in the above sorter 110 constitute the sorter 110.

The control means 15, 25, . . . provided in each supply means 10, 20, . . . and the control means 115, 215, . . . provided in each sorter 110, 210, . . . are each connected to the control means 5 via a transmission means 6, and controlled by instructions from the control means 5.

The perspective view in FIG. 2 showing an example 1000 of the transfer means 16, 26, . . . or the transfer means 114, 124, . . . , 214, . . . , and the plurality of gate means 4 or the plurality of gate means 117 . . . , and the perspective view in FIG. 3 showing an example 2000 of the transfer means for changing the transfer direction are also applicable to this embodiment.

A block diagram of the control means 5, a block diagram of the control means 15, 25, . . . for the supply means 10, 20, . . . , and a block diagram of the control means 115, 215, . . . for the sorter 110, 210, . . . are as shown in FIGS. 4, 5, and 6 for the above embodiment, respectively.

The operations of the above sorter system of the embodiments of this invention, that is, the sorting and sequencing operations are described below.

To use the sorter system according to this invention to perform a sorting operation, the indication that this is a sorting operation and the range of sorting information to be shared by each sorter 110, 210, . . . are input from the input means 508 of the control means 5 in FIG. 9 or 4. The range of sorting information to be shared by each sorter 110, 210, . . . may be stored in the storage section 501 in advance, and selected according to the contents of the sorting operation.

Based on the information input from the input means 508, the indication that this is a sorting operation is transmitted to each of the control means 15, 25, . . . and 115, 215, . . . , the information on the assignment of the corresponding sorters 110, 210, . . . to the movable hopper means 200 standing by in a plurality of standby guide paths 101, 102, 103, 104, . . . is transmitted to each of the control means 15, 25, . . . , and the range of sorting information to be shared by each sorter 110, 210, . . . is transmitted to each of the control means 115, 215, . . . , via the control signal transmission control section 504 and transmission means 6 under instructions from the CPU 500. This information is then stored in the control means 115, 215 . . . The control means 15, 25, . . . in the supply means 10, 20, . . . in FIG. 9 or 5 receives information transmitted by the control means 5 via the transmission means 6.

The processing within the control means 15, 25, . . . is then described with reference to the control means 15 in FIG. 5, but the following description is also applicable to the other control means 25, . . .

The information transmitted to the control means 15 via the transmission means 6 is received by the control signal transmission control section 153 and stored in the storage section 152, and the CPU 151 controls each means for the sorting operation based on the information stored in the storage section 152, and assigns the corresponding sorters 110, 210, . . . to the movable hopper means 200 standing by in a plurality of standby guide paths 101, 102, 103, 104, . . . Likewise, the control means 115, 215, . . . for the sorter 110, 210, . . . in FIG. 9 or 6 receives information transmitted from the control means 5 via the transmission means 6. The operation of the control means 115, 215, . . . is then described with reference to the control means 115 in FIG. 6, but the following description is also applicable to the other control means 215, . . .

The information transmitted to the control means 115 via the transmission means 6 is received by the control signal transmission control section 1153 and stored in the storage section 1152, and the CPU 1151 controls each means for the sorting operation by defining the range of sorting information to be shared for each of the plurality of sorting shelves 116 based on the information stored in the storage section 1152.

Sheets 1 to be sorted are then set in the hopper 11, 21, . . . in the supply means 10, 20, . . . in FIG. 9 or 5. The sheets 1 set in the hopper 11, 21, . . . are separated by the singulating means 12, 22, . . . driven by control signals from the singulator control section 154 in the control section 15, 25, . . . The separated sheets 1 are fed by the transfer means 14, 24, . . . to the sorting information reading means 13, 23, . . . The sorting information attached to each sheet 1 is read by the sorting information reading means 13, 23, . . . , and loaded in the control means 15, 25, . . . via the sorting information control section 155, . . .

The control means 15, 25, . . . compares the sorting information read by the sorting information reading means 13, 23, . . . and transmitted to the control means 15, 25, . . . via the sorting information control section 155, . . . to the sorting information to be shared by each sorter 110, 120, . . . , 210, . . . which has been transmitted by the control means 5 in order to determine the sorter 110, 210, . . . to which the sheet 1 is to be transferred and to determine the driving conditions for the gate means 4 provided in the transfer means 16, 26, . . . which are required to transfer the sheet 1 to the movable hopper means 200 standing by in the standby guide path corresponding to the sorter 110, 210, . . . determined.

In response to this determination, the CPU 151 controls the gate means 4 provided in the transfer means 16, 26, . . . via the gate control section 156. The sheets 1 from which the sorting information has been read by the sorting information reading means 13, 23, . . . are transferred by the transfer means 16, 26, . . . and the gate means 4 to the respective specified movable hopper means 200. The remaining sheets 1 set in the hopper 11, 21, . . . are similarly processed and transferred to the respective specified movable hopper means 200. Once the stacking of the sheets 1 has been finished, the movable hopper means 200 are sequentially driven by control signals from the control means 5 and guided to the respective sorters 110, 210, . . . through the guide paths 100 and specified draw-in guide paths 105, 106, . . . , using the guide switching means 108.

The operation of the sorter 110, 210, . . . is described with reference to the sorter 110 in FIG. 9 or 6, but the following description is also applicable to the other sorters 210, . . . The movable hopper means 200 drawn into the sorter 110 through the draw-in guide path 105 has its opening and closing shutter means 202 opened by a control signal from the singulator control section 1154 in the control means 115, and then delivers the sheets 1 therein to the singulating means 112 by a push plate means 201.

The sheets 1 in the movable hopper means 200 are separated by the singulating means 112 driven by a control signal of the singular control section 1154 in the control means 15. The separated sheets 1 are fed by the transfer means 114 to the sorting information reading means 113. The sorting information attached to the sheets 1 is read by the sorting information reading means 113 and loaded in the control means 115 via the sorting information control section 1155.

The control means 115 compares the sorting information read by the sorting information reading means 113 and transmitted to the control means 115 via the sorting information control section 1155 to the sorting information to be shared which is defined for each of the plurality of sorting shelves 116 in order to determine the sorting shelf 116 in which the sheet is to be stacked and to control the gate means 117 in the transfer means 114. The sheets 1 from which the sorting information has been read by the sorting information reading means 113 are stacked in a specified one of the plurality of sorting shelves 116 by the transfer means 114 and gate means 117. In this manner, the sorting shelves 116, 216, . . . in the sorters 110, 210, . . . can be used to perform the sorting operation according to the sorting information of the sheets 1.

Next, the sheet sequencing operation is described.

To use the sorter system according to this invention to perform a sequencing operation, the indication that this is a sequencing operation and the range of sorting information to be sequenced are input from the input means 508 of the control means 5 in FIG. 9 or 4. The range of sorting information to be sequenced may be stored in the storage section 501 in advance, and selected according to the contents of the sequencing operation.

Based on the information input from the input means 508, the indication that this is a sequencing operation is transmitted to each of the control means 15, 25, . . . and 115, 125, . . . , 215, . . . , the information on the assignment of the corresponding sorters 110, 210, . . . to the movable hopper means 200 standing by in a plurality of standby guide paths 101, 102, 103, 104, . . . is transmitted to each of the control means 15, 25, . . . , and the range of sorting information to be sequenced and shared by each sorter 110, 120, . . . , 210, . . . is transmitted to each of the control means 115, 215, . . . , via the control signal transmission control section 504 and transmission means 6 under instructions from the CPU 500. This information is then stored in the control means 115, 215, . . .

The control means 15, 25, . . . in the supply means 10, 20, . . . in FIG. 9 or 5 receives information transmitted by the control means 5 via the transmission means 6. The processing within the control means 15, 25, . . . is then described with reference to the control means 15 in FIG. 5, but the following description is also applicable to the other control means 25, . . . The information transmitted to the control means 15 via the transmission means 6 is received by the control signal transmission control section 153 and stored in the storage section 152, and the CPU 151 controls each means for the sequencing operation based on the information stored in the storage section 152, and assigns the corresponding sorters 110, 210, . . . to the movable hopper means 200 standing by in a plurality of standby guide paths 101, 102, 103, 104, . . . Likewise, the control means 115, 215, . . . in the sorter 110, 210, . . . in FIG. 9 or 6 receives information transmitted from the control means 5 via the transmission means 6. The operation of the control means 115, 215, . . . is then described with reference to the control means 115 in FIG. 6, but the following description is also applicable to the other control means 215, . . .

The information transmitted to the control means 115 via the transmission means 6 is received by the control signal transmission control section 1153 and stored in the storage section 1152. The CPU 1151 controls each means for the sequencing operation by defining the range of sorting information to be shared for each of the plurality of sorting shelves 116 based on the information stored in the storage section 1152.

Sheets 1 to be sequenced are then set in the hopper 11, 21, . . . in the supply means 10, 20, . . . in FIG. 9 or 5. The sheets 1 set in the hopper 11, 21, . . . are separated by the singulating means 12, 22, . . . driven by control signals from the singulator control section 154 in the control section 15, 25, . . . The separated sheets 1 are fed by the transfer means 14, 24, . . . to the sorting information reading means 13, 23, . . . The sorting information attached to each sheet 1 is read by the sorting information reading means 13, 23, . . . , and loaded in the control means 15, 25, . . . via the sorting information control section 155, . . .

The control means 15, 25, . . . compares the sorting information read by the sorting information reading means 13, 23, . . . and transmitted to the control means 15, 25, . . . via the sorting information control section 155, . . . to the range of the sorting information to be sequenced by each sorter 110, 210, . . . which has been transmitted by the control means 5 in order to determine the sorter 110, 210, . . . to which the sheet 1 is to be transferred and to determine the driving conditions for the gate means 4 provided in the transfer means 16, 26, . . . which are required to transfer the sheet 1 to the movable hopper means 200 standing by in the standby guide path corresponding to the sorter 110, 210, . . . determined.

In response to this determination, the CPU 151 controls the gate means 4 provided in the transfer means 16, 26, . . . via the gate control section 156. The sheets 1 from which the sorting information has been read by the sorting information reading means 13, 23, . . . are transferred by the transfer means 16, 26, . . . and the gate means 4 to the respective specified hopper means 200. The remaining sheets 1 set in the hopper 11, 21, . . . are similarly processed and transferred to the respective specified movable hopper means 200. Once the stacking of the sheets 1 has been finished, the movable hopper means 200 are sequentially driven by control signals from the control means 5 and guided to the respective sorters 110, 210, . . . through the guide paths 100 and specified draw-in guide paths 105, 106, . . . , using the guide switching means 108.

The operator inputs the starting of the sequencing operation from the input means 508 of the control means 5. This information on the starting of the sequencing operation is transmitted to the control means 115, 215, . . . for each sorter 110, 210, . . . by the control means 5 via the transmission means 6 as described above. The sequencing operation in the sorter 110, 210, . . . is subsequently described with reference to the sorter 110 in FIG. 9 or 6, but the following description is also applicable to the other sorters 210, . . . The range of sorting information to be sequenced is stored in the control means 115 in the sorter 110 in advance, as described above. Each piece of sorting information contained in the range of sorting information is numbered in the order that the pieces of information are to be sequenced. These numbers are then stored in the storage section 1152. The process of numbering each piece of information and storing the numbers in the storage section can be carried out after the range of information to be sequenced has been transmitted to each control means. For simplicity of description,. it is assumed that the plurality of sorting shelves 116 comprise ten sorting shelves and that the sorting information comprises 100 pieces of information and is equivalent for the numbers 0 to 99.

The operator first confirms through the display means 1159 the information on the starting of the sequencing operation, and then inputs the starting of the sequencing operation from the input means 1160 of the control means 115. The CPU 1151 sees only the units digits of the numbers 0 to 99 attached to the pieces of sorting information to define the number 0 to 9 for the 10 sorting shelves 116. Sheets 1 stacked in the movable hopper means 200 are separated by the singulating means 112 driven by control signals from the singulating section 1154 in the control means 115. The separated sheets 1 are fed by the transfer means 114 to the sorting information reading means 113. The sorting information attached to the sheets 1 is read by the sorting information reading means 113 and loaded in the control means 115 via the sorting information control section 1155, . . . The control means 115 compares the units digits 0 to 9 of the numbers for sequencing which correspond to the sorting information read by the sorting information reading means 113 to the units digits 0 to 9 defined for the ten sorting shelves 116 in order to determine the sorting shelf 116 to which the sheet 1 is to be transferred and to determine the driving conditions for the gate means 117 provided in the transfer means 114 which are required to transfer the sheet 1 to the sorting shelf 116 determined.

In response to this determination, the CPU 1151 controls the gate means 17 provided in the transfer means 114 via the gate control section 1156. The sheets 1 from which the sorting information has been read by the sorting information reading means 13 are transferred by the transfer means 114 and gate means 117 to the respective specified sorting shelves 116. The remaining sheets 1 set in the movable hopper means 200 are similarly processed. After ensuring that all the sheets have been transferred to the respective specified sorting shelves 116, the operator inputs the stopping of each means of the sorter 110 from the input means 1160 of the control means 115 to stop each means.

The sheets with units digits 0 to 9 have been sorted and stacked in the respective sorting shelves 116. The operator sequentially takes out the sheets 1 from the sorting shelf 116 with a units digit of 9 and resets them on the singulating means 112 side of the movable hopper means 200. Likewise, the operator sequentially takes out the sheets 1 from the sorting shelves 116 with units digits 8 to 0 and resets them on the side of the movable hopper means 200 opposed to the singulating means 112. Once the resetting has been finished, the operator inputs restarting from the input means 1160 of the control means 115. The CPU 1151 then sees only the tens digits of the numbers 0 to 99 attached to the sorting information, and defines these numbers 0 to 9 for the sorting shelves 116. As in the units digits, the sheets 1 reset in the movable hopper means 200 are separated by the singulating means 112 driven by control signals from the singulating control section 1154 of the control means 115.

The separated sheets 1 are transferred by the transfer means 114 to the sorting information reading means 113. The sorting information attached to the sheets 1 is read by the sorting information reading means 113 and loaded in the control means 115 via the sorting information control section 1155, .The control means 115 compares the tens digits of the numbers for sequencing which correspond to the sorting information read by the sorting information reading means 113 to the tens digits 0 to 9 defined for the ten sorting shelves 116 in order to determine the sorting shelf 116 to which the sheet 1 is to be transferred and to determine the driving conditions for the gate means 117 provided in the transfer means 114 which are required to transfer the sheet 1 to the sorting shelf 116 determined.

In response to this determination, the CPU 1151 controls via the gate control section 1156 the gate means 117 provided in the transfer means 114. The sheets 1 from which the sorting information has been read by the sorting information reading means 13 are transferred by the transfer means 114 and gate means 117 to the respective specified sorting shelves 116. The remaining sheets 1 set in the movable hopper means 200 are similarly processed. After ensuring that all the sheets have been transferred to the respective specified sorting shelves 116, the operator inputs the stopping of each means of the sorter 110 from the input means 1160 of the control means 115 to stop each means. The sheets with tens digits 0 to 9 have been sorted and stacked in the respective sorting shelves 116. As described above, the sheets 1 with the units digits 9 to 0 have been sequentially reset in the movable hopper means 200 and are to be processed in this order, so the sheets with the units digits 9 to 0 are sequentially stacked in the respective sorting shelves 116. The sheets 1 can be sequenced in a specified order by sequentially taking out the sheets 1 in the sorting shelf 116 defined with a tens digit of 9 from the sorting shelf 116 defined with a tens digit of 0.

Although the above example has been described in conjunction with the assumption that the sorting information comprises 100 pieces of information, a similar sequencing operation can be performed by carrying out a sorting operation a certain number of times equal to the number of the digits of the total number of pieces of information. In addition, although in the above method, the operator sequentially takes out the sheets 1 from the sorting shelves 116 and sets them in the movable hopper means 200 in each sorting operation corresponding to each digit, the operation of taking out the sheets 1 from the sorting shelves can be automated.

As described above, the embodiment of the sorter system according to this invention can sort and sequence the sheets 1 with the sorting information attached thereto.

Although the embodiments of this invention has been described in conjunction with the system comprising the supply means 10, 20, . . . , the system may comprise the sorters 110, 210, . . . instead of the supply means 10, 20, . . . , as shown in the third embodiment.

As described above, the embodiments of this invention can perform sorting operations such as destination and delivery sorting operations by managing as a group sorters capable of a plurality of sequencing operations, and can also execute sequencing operations such as a carrier route sequencing operation by managing a plurality of sorters as individual sorter units. As a result, this invention can provide a sorter system capable of expanding sorting and sequencing functions, and also reduce costs and a required installation space. This invention also serves to enhance the capability of supplying sheets 1 to the sorter because the separation of sheets 1, the reading of sorting information, and transfer to the sorter can be carried out asynchronously in the plurality of supply means.

This invention can perform sorting operations such as destination and delivery sorting operations by managing as a group sorters capable of a plurality of sequencing operations, and can also execute sequencing operations such as a carrier route sequencing operation by managing a plurality of sorters as individual sorter units. As a result, this invention can provide a sorter system capable of expanding sorting and sequencing functions, and also reduce costs and a required installation space.

What is claimed is:

1. A sorter system for sorting sheets according to sorting information attached to the sheets, comprising:

first singulation means for separating sheets to be sorted:

first transfer means for transferring the sheets separated by said first singulating means;

first sorting information reading means for reading sorting information from the sheets transferred by said first transfer means;

second transfer means coupled to said first sorting information reading means; and a plurality of independent sorters each including hopper means, second singulating means, second sorting information reading means and stacking means, and coupled to the second transfer means so that any number of sorters can be added or removed from said sorters as required, the sorters loading the sheets therein according to the sorting information read by at least one of the first and second sorting information reading means.

2. A sorter system for sorting sheets according to sorting information attached to the sheets, comprising:

first singulation means for separating sheets to be sorted;

first transfer means for transferring the sheets separated by said first singulating means;

first sorting information reading means for reading sorting information from the sheets transferred by said first transfer means;

first control means for controlling said first singulating means, said first transfer means, and said first sorting information reading means;

second transfer means coupled to said first sorting information reading means;

a plurality of independent sorters each including hopper means, second singulating means, second sorting information reading means and stacking means, and coupled to the second transfer means in such a way that any number of sorters can be added or removed from said sorters as required, the sorters loading the sheets therein according to the sorting information read by at least one of the first and second sorting information reading means; and a second control means for switching and controlling the operations of said first control means and said plurality of sorters so that they can act as a destination sorting operation sorter, a delivery sorting operation sorter, or a carrier route sequencing operation sorter.

3. A sorter system for sorting sheets according to sorting information attached to the sheets, comprising:

first plurality of singulating means for separating sheets to be sorted;

first transfer means for transferring the sheets separated by said first singulating means respectively;

first sorting information reading means for reading sorting information from the sheets transferred by said first transfer means;

second transfer means coupled to said first sorting information reading means; and a plurality of independent sorters each including hopper means, second singulating means, second sorting information reading means and stacking means, and coupled to said transfer means so that any number of sorters can be added or removed from the sorters as required, the sorters loading the sheets therein according to the sorting information read by at least one of the first and second sorting information reading means.

4. A sorter system for sorting sheets according to sorting information attached to the sheets, comprising:

first plurality of singulating means for separating sheets to be sorted;

first transfer means for transferring the sheets separated by said first singulating means, the first transfer means corresponding to the first singulating means, respectively;

first sorting information reading means for reading sorting information from the sheets transferred by said first transfer means, respectively;

first control means for controlling said first singulating means, said first transfer means and said first sorting information reading means, the first control means corresponding to said first singulating means, said first transfer means and said first sorting information reading means, respectively;

second transfer means coupled to said first sorting information reading means in such a way that any number of convey means can be added or removed from said second transfer means as required;

a plurality of independent sorters each including hopper means, second singulating means, second sorting information reading means and stacking means, and coupled to said second transfer means in such a way that any number of sorters can be added or removed from said sorters as required, the sorters loading the sheets therein according to the sorting information read by at least one of the first and second sorting information reading means; and a second control means for switching and controlling the operations of said first control means and said plurality of sorters so that they can act as a destination sorting operation sorter, a delivery sorting operation sorter, or a carrier route sequencing operation sorter.

5. A sorter system for sorting sheets according to sorting information attached to the sheets, comprising:

a first hopper means for setting the sheets to be sorted;

first singulating means for separating the sheets in said first hopper means;

first transfer means for transferring the sheets separated by said first singulating means;

first sorting information reading means for reading sorting information from the sheets transferred by said first transfer means;

second transfer means coupled to said first sorting information reading means in such a way that any number of convey means can be added or removed from said second transfer means as required;

a plurality of independent sorters each including second hopper means, second singulating means, second sorting information reading means and stacking means, and coupled to the second transfer means so that any number of sorters can be added or removed from said sorters as required, the sorters loading the sheets therein according to the sorting information read by at least one of the first and second sorting information reading means; and a plurality of gate means provided in said second transfer means and controlled on the basis of the sorting information read by at least one of the first and second sorting information reading means.

6. A sorter system for sorting sheets according to sorting information attached to the sheets, comprising:

first hopper means for setting sheets to be sorted;

first singulating means for separating the sheets in said first hopper means;

first transfer means for transferring the sheets separated by said first singulating means;

first sorting information reading means for reading sorting information from the sheets transferred by said first transfer means;

first control means for controlling said first singulating means, said first transfer means, and said first sorting information reading means;

second transfer means coupled to said first sorting information reading means in such a way that any number of convey means can be added or removed from said second transfer means as required;

a plurality of independent sorters each including second hopper means, second singulating means, second sorting information reading means and stacking means, and coupled to the second transfer means so that any number of sorters can be added or removed from said sorters as required, the sorters loading the sheets therein according to the sorting information read by at least one of the first and second sorting information reading means;

a plurality of gate means provided in said second transfer means and controlled on the basis of the sorting information read by at least one of said first and second sorting information reading means: and a second control means for switching and controlling the operations of said first control means and said plurality of sorters so that they can act as a destination sorting operation sorter, a delivery sorting operation sorter, or a carrier route sequencing operation sorter.

7. A sorter system for sorting sheets according to sorting information attached to the sheets, comprising:

first hopper means for setting sheets to be sorted;

first singulating means for separating the sheets in said first hopper means;

first transfer means for transferring the sheets separated by said first singulating means;

first sorting information reading means for reading sorting information from the sheets transferred by said first transfer means;

a plurality of independent sorters each including second hopper means, second singulating means, second sorting information reading means and stacking means, and for loading the sheets therein according to the sorting information read by at least one of the first and second sorting information reading means wherein any number of sorters can be added or removed from said sorters as required;

second transfer means for transferring each sheet to one of the plurality of sorters according to the sorting information read by said sorting information reading means, the transfer means coupled together in such a way that any number of convey means can be added or removed from said transfer means as required; and a plurality of gate means provided in said second transfer means and controlled on the basis the sorting information read by at least one of said first and second sorting information reading means.

8. A sorter system for sorting sheets according to sorting information attached to the sheets, comprising:

first hopper means for setting sheets to be sorted;

first singulating means for separating the sheets in said first hopper means;

first transfer means for transferring the sheets separated by said first singulating means;

first sorting information reading means for reading sorting information from the sheets transferred by said first transfer means;

first control means for controlling said first singulating means, said first transfer means, and said first sorting information reading means;

a plurality of independent sorters each including second hopper means, second singulating means, second sorting information reading means and stacking means, and for loading the sheets therein according to the second sorting information read by at least one of the first and second sorting information reading means wherein any number of sorters can be added or removed from said sorters as required;

second transfer means for transferring each sheet to one of the plurality of sorters according to the sorting information read by at least one of said first and second sorting information reading means, the transfer means coupled together in such a way that any number of convey means can be added or removed from said transfer means as required;

a plurality of gate means provided in said second transfer means and controlled on the basis of the sorting information read by at least one of said first and second sorting information reading means; and second control means for switching and controlling the operations of said first control means and said plurality of sorters so that they can act as a destination sorting operation sorter, a delivery sorting operation sorter, or a carrier route sequencing operation sorter.

9. A sorter system for sorting sheets according to sorting information attached to the sheets, comprising:

first hopper means for setting sheets to be sorted;

a plurality of first singulating means for separating the sheets in said first hopper means, the first singulating means corresponding to said first hopper means;

first transfer means for transferring the sheets separated by said first singulating means, the first transfer means corresponding to said first singulating means;

first sorting information reading means for reading sorting information from the sheets transferred by said first transfer means, the first sorting information reading means corresponding to said first transfer means;

control means for controlling said first singulating means, said first transfer means, and said first sorting information reading means;

a plurality of independent sorters each including second hopper means, second singulating means, second sorting information reading means and stacking means, and for loading the sheets therein according to the sorting information read by at least one of the first and second sorting information reading means;

second transfer means for transferring each sheet to one of the plurality of sorters according to the sorting information read by at least one of said first and second sorting information reading means, the second transfer means being coupled together in such a way that any number of convey means can be added or removed from said second transfer means as required; and a plurality of gate means provided in said second transfer means and controlled on the basis of the sorting information read by at least one of said first and second sorting information reading means.

10. A sorter system for sorting sheets according to sorting information attached to the sheets, comprising:

first hopper means for setting sheets to be sorted;

a plurality of first singulating means for separating the sheets in said first hopper means, the first singulating means corresponding to said first hopper means;

first transfer means for transferring the sheets separated by said first singulating means, the first transfer means corresponding to said first singulating means;

first sorting information reading means for reading sorting information from the sheets transferred by said first transfer means, the first sorting information reading means corresponding to said first transfer means;

first control means for controlling said first singulating means, said first transfer means, and said first sorting information reading means;

a plurality of independent sorters each including second hopper means, second singulating means, second sorting information reading means and stacking means, and for loading the sheets therein according to the sorting information read by at least one of the first and second sorting information reading means;

second transfer means for transferring each sheet to one of the plurality of sorters according to the sorting information read by at least one of said first and second sorting information reading means, the second transfer means being coupled together in such a way that any number of convey means can be added or removed from said second transfer means as required;

a plurality of gate means provided in said second transfer means and controlled on the basis of the sorting information read by at least one of said first and second sorting information reading means; and a second control means for switching and controlling the operations of said first control means and said plurality of sorters so that they can act as a destination sorting operation sorter, a delivery sorting operation sorter, or a carrier route sequencing operation sorter.

11. A sorter system for sorting sheets according to sorting information attached to the sheets, comprising:

first hopper means for setting sheets to be sorted;

first singulating means for separating the sheets in said first hopper means, the first singulating means corresponding to said first hopper means;

first transfer means for transferring the sheets separated by said first singulating means, the first transfer means corresponding to said first singulating means;

first sorting information reading means for reading sorting information from the sheets transferred by said first transfer means, the first sorting information reading means corresponding to said first transfer means;

first control means for controlling said first singulating means, said first transfer means, and said first sorting information reading means, the first control means corresponding to said first singulating means, said first transfer means, and said first sorting information reading means, respectively;

a plurality of independent sorters each including second hopper means, second singulating means, second sorting information reading means and stacking means, and for loading the sheets therein according to the sorting information read by at least one of the first and second sorting information reading means wherein any number of sorters can be added or removed from said sorters as required;

second transfer means for transferring each sheet to one of the plurality of sorters according to the sorting information read by at least one of said first and second sorting information reading means, the second transfer means coupled together in such a way that any number of convey means can be added or removed from said second transfer means as required; and a plurality of gate means provided in said second transfer means and controlled on the basis of the sorting information read by at least one of said first and second sorting information reading means.

12. A sorter system for sorting sheets according to sorting information attached to the sheets, comprising:

first hopper means for setting sheets to be sorted;

a plurality of first singulating means for separating the sheets in said first hopper means, the first singulating means corresponding to said first hopper means;

first transfer means for transferring the sheets separated by said first singulating means, the first transfer means corresponding to said first singulating means;

first sorting information reading means for reading sorting information from the sheets transferred by said first transfer means, the first sorting information reading means corresponding to said first transfer means;

first control means for controlling said first singulating means, said first transfer means, and said first sorting information reading means, the first control means corresponding to said first singulating means, said first transfer means, and first sorting information reading means, respectively;

a plurality of independent sorters each including second hopper means, second singulating means, information read by at least one of the first and second sorting information reading means wherein any number of sorters can be added or removed from said sorters as required;

second transfer means for transferring each sheet to one of the plurality of sorters according to the sorting information read by at least one of said first and second sorting information reading means, the second transfer means being coup led together in such a way that any number of convey means can be added or removed from said second transfer means as required;

a plurality of gate means provided in said second transfer means and controlled on the basis of the sorting information read by at least one of said first and second sorting information reading means; and second control means for switching and controlling the operations of said first control means and said plurality of sorters so that they can act as a destination sorting operation sorter, a delivery sorting operation sorter, or a carrier route sequencing operation sorter.

13. A sorter system for sorting sheets according to sorting information attached to the sheets, comprising:

a hopper means for setting the sheets to be sorted;

a singulating means for separating the sheets in said hopper means;

a transfer means for transferring the sheets separated by said singulating means;

a sorting information reading means for reading sorting information from the sheets transferred by said transfer means;

a control means for controlling said singulating means, said transfer means, and said sorting information reading means;

transfer means for transferring the sheets according to the sorting information read by said sorting information reading means, the transfer means coupled together in such a way that any number of convey means can be added or removed from said transfer means as required;

a plurality of gate means provided in said transfer means and controlled on the basis of the sorting information read by said sorting information reading means;

a plurality of movable hopper means coupled to said transfer means via said gate means;

guide paths for guiding said movable hopper means;

a plurality of guide switching means provided in the middle of the guide path and controlled by said control means; and a plurality of sorters coupled to said guide paths via said guide switching means for loading the sheets therein from said movable hopper means.

14. A sorter system for sorting sheets according to sorting information attached to the sheets, comprising:

a hopper means for setting sheets to be sorted;

a singulating means for separating the sheets in said hopper means;

a transfer means for transferring the sheets separated by said singulating means;

a sorting information reading means for reading sorting information from the sheets transferred by said transfer means;

a control means for controlling said singulating means, said transfer means, and said sorting information reading means;

transfer means for transferring the sheets according to the sorting information read by said sorting information reading means, the transfer means coupled together in such a way that any number of convey means can be added or removed from said transfer means as required;

a plurality of gate means provided in said transfer means and controlled on the basis of the sorting information read by said sorting information reading means;

a plurality of movable hopper means coupled to said transfer means via said gate means;

guide paths for guiding said movable hopper means;

a plurality of guide switching means provided in the middle of the guide path and controlled by said control means;

a plurality of sorters coupled to said guide paths via said guide switching means for loading the sheets therein from said movable hopper means; and control means for switching and controlling the operations of said control means and said plurality of sorters so that they can act as a destination sorting operation sorter, a delivery sorting operation sorter, or a carrier route sequencing operation sorter.

15. A sorter system for sorting sheets according to sorting information attached to the sheets, comprising:

a hopper means for setting sheets to be sorted;

a singulating means for separating the sheets in said hopper means;

a transfer means for transferring the sheets separated by said singulating means;

a sorting information reading means for reading sorting information from the sheets transferred by said transfer means;

a control means for controlling said singulating means, said transfer means, and said sorting information reading means;

transfer means for transferring the sheets according to the sorting information read by said sorting information reading means, the transfer means coupled together in such a way that any number of convey means can be added or removed from said transfer means as required;

a plurality of gate means provided in said transfer means and controlled on the basis of the sorting information read by said sorting information reading means;

a plurality of movable hopper means coupled to said transfer means via said gate means in such a way that any number of movable hopper means can be added or removed from said movable hopper means as required;

guide paths for guiding said movable hopper means;

a plurality of guide switching means provided in the middle of the guide path and controlled by said control means; and a plurality of sorters coupled to said guide paths via said guide switching means for loading the sheets therein from said movable hopper means wherein any number of sorters can be added or removed from said sorters as required.

16. A sorter system for sorting sheets according to sorting information attached to the sheets, comprising:

a hopper means for setting the sheets to be sorted;

a singulating means for separating the sheets in said hopper means;

a transfer means for transferring the sheets separated by said singulating means;

a sorting information reading means for reading sorting information from the sheets transferred by said transfer means;

a first control means for controlling said singulating means, said transfer means, and said sorting information reading means;

transfer means for transferring the sheets according to the sorting information read by said sorting information reading means, the transfer means coupled together in such a way that any number of convey means can be added or removed from said transfer means as required;

a plurality of gate means provided in said transfer means and controlled on the basis of the sorting information read by said sorting information reading means;

a plurality of movable hopper means coupled to said transfer means via said gate means in such a way that any number of movable hopper means can be added or removed from said movable hopper means as required;

guide paths for guiding said movable hopper means;

a plurality of guide switching means provided in the middle of the guide path and controlled by said control means;

a plurality of sorters coupled to said guide paths via said guide switching means for loading the sheets therein from said movable hopper means wherein any number of sorters can be added or removed from said sorters as required; and a second control means for switching and controlling the operations of said control means and said plurality of sorters so that they can act as a destination sorting operation sorter, a delivery sorting operation sorter, or a carrier route sequencing operation sorter.

17. A sorter system for sorting sheets according to sorting information attached to the sheets, comprising:

a hopper means for setting sheets to be sorted;

a plurality of singulating means for separating the sheets in said hopper means, the singulating means corresponding to said hopper means;

transfer means for transferring the sheets separated by said singulating means, the transfer means corresponding to said singulating means;

sorting information reading means for reading sorting information from the sheets transferred by said transfer means, the sorting information reading means corresponding to said transfer means;

control means for controlling said singulating means, said transfer means, and said sorting information reading means, the control means corresponding to said singulating means, said transfer means, and said sorting information reading means, respectively;

transfer means for transferring the sheets according to the sorting information read by said sorting information reading means, the transfer means coupled together in such a way that any number of convey means can be added or removed from said transfer means as required;

a plurality of gate means provided in said transfer means and controlled on the basis of the sorting information read by said sorting information reading means;

a plurality of movable hopper means coupled to said transfer means via said gate means;

guide paths for guiding said movable hopper means;

a plurality of guide switching means provided in the middle of the guide path and controlled by said control means; and a plurality of sorters coupled to said guide paths via said guide switching means for loading the sheets therein from said movable hopper means.

18. A sorter system for sorting sheets according to sorting information attached to the sheets, comprising:

a hopper means for setting the sheets to be sorted;

a plurality of singulating means for separating the sheets in said hopper means, the singulating means corresponding to said hopper means;

transfer means for transferring the sheets separated by said singulating means, the transfer means corresponding to said singulating means;

sorting information reading means for reading sorting information from the sheets transferred by said transfer means, the sorting information reading means corresponding to said transfer means;

first control means for controlling said singulating means, said transfer means, and said sorting information reading means, the control means corresponding to said singulating means, said transfer means, and said sorting information reading means, respectively;

transfer means for transferring the sheets according to the sorting information read by said sorting information reading means, the transfer means coupled together in such a way that any number of convey means can be added or removed from said transfer means as required;

a plurality of gate means provided in said transfer means and controlled on the basis of the sorting information read by said sorting information reading means;

a plurality of movable hopper means coupled to said transfer means via said gate means;

guide paths for guiding said movable hopper means;

a plurality of guide switching means provided in the middle of the guide path and controlled by said control means;

a plurality of sorters coupled to said guide paths via said guide switching means for loading the sheets therein from said movable hopper means; and a second control means for switching and controlling the operations of said control means and said plurality of sorters so that they can act as a destination sorting operation sorter, a delivery sorting operation sorter, or a carrier route sequencing operation sorter.

19. A sorter system for sorting sheets according to sorting information attached to the sheets, comprising:

a hopper means for setting the sheets to be sorted;

a plurality of singulating means for separating the sheets in said hopper means, the singulating means corresponding to said hopper means;

transfer means for transferring the sheets separated by said singulating means, the transfer means corresponding to said singulating means;

sorting information reading means for reading sorting information from the sheets transferred by said transfer means, the sorting information reading means corresponding to said transfer means;

control means for controlling said singulating means, said transfer means, and said sorting information reading means, the control means corresponding to said singulating means, said transfer means, and said sorting information reading means, respectively;

transfer means for transferring the sheets according to the sorting information read by said sorting information reading means, the transfer means coupled together in such a way that any number of convey means can be added or removed from said transfer means as required;

a plurality of gate means provided in said transfer means and controlled on the basis of the sorting information read by said sorting information reading means;

a plurality of movable hopper means coupled to said transfer means via said gate means;

guide paths for guiding said movable hopper means, the guide paths coupled together in such a way that any number of guide paths can be added or removed from said guide paths as required;

a plurality of guide switching means provided in the middle of the guide path and controlled by said control means; and a plurality of sorters coupled to said guide paths via said guide switching means for loading the sheets therein from said movable hopper means, the sorters coupled together in such a way that any number of sorters can be added or removed from said sorters as required.

20. A sorter system for sorting sheets according to sorting information attached to the sheets, comprising:

a hopper means for setting sheets to be sorted;

a plurality of singulating means for separating the sheets in said hopper means, the singulating means corresponding to said hopper means;

transfer means for transferring the sheets separated by said singulating means, the transfer means corresponding to said singulating means;

sorting information reading means for reading sorting information from the sheets transferred by said transfer means, the sorting information reading means corresponding to said transfer means;

first control means for controlling said singulating means, said transfer means, and said sorting information reading means, the control means corresponding to said singulating means, said transfer means, and said sorting information reading means, respectively;

transfer means for transferring the sheets according to the sorting information read by said sorting information reading means, the transfer means coupled together in such a way that any number of convey means can be added or removed from said transfer means as required;

a plurality of gate means provided in said transfer means and controlled on the basis of the sorting information read by said sorting information reading means;

a plurality of movable hopper means coupled to said transfer means via said gate means;

guide paths for guiding said movable hopper means, the guide paths coupled together in such a way that any number of guide paths can be added or removed from said guide paths as required;

a plurality of guide switching means provided in the middle of the guide path and controlled by said control means;

a plurality of sorters coupled to said guide paths via said guide switching means for loading the sheets therein from said movable hopper means, the sorters coupled together in such a way that any number of sorters can be added or removed from said sorters as required; and a second control means for switching and controlling the operations of said control means and said plurality of sorters so that they can act as a destination sorting operation sorter, a delivery sorting operation sorter, or a carrier route sequencing operation sorter.

21. A sorter system according to any one of claims 1 to 12, wherein each of the plurality of sorters comprises:

third transfer means for transferring the separated sheets from said second singulating means;

a plurality of other gate means provided in said third transfer means and controlled on the basis of the sorting information read by said second sorting information reading means; and said stacking means includes a plurality of sorting shelves coupled to said third transfer means via said other gate means.

22. A sorter system according to claim 21, wherein said sorters stack in the hopper means thereof the sheets transferred from the second transfer means.

23. A sorter system according to claim 21, wherein said plurality of sorters connect the respective third transfer means to the respective second transfer means to stack the sheets, transferred from the respective third transfer means, in the respective sorting shelves.

* * * * *